US011877715B2

(12) United States Patent
Kim et al.

(10) Patent No.: US 11,877,715 B2
(45) Date of Patent: Jan. 23, 2024

(54) CLEANER HEAD AND VACUUM CLEANER HAVING THE SAME

(71) Applicant: Samsung Electronics Co., Ltd., Suwon-si (KR)

(72) Inventors: Taegwang Kim, Suwon-si (KR); Dongwoo Ha, Suwon-si (KR); Kihwan Kwon, Suwon-si (KR); Seokman Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 502 days.

(21) Appl. No.: 16/993,481

(22) Filed: Aug. 14, 2020

(65) Prior Publication Data

US 2021/0045597 A1 Feb. 18, 2021

(30) Foreign Application Priority Data

Aug. 14, 2019 (KR) ..... 10-2019-0099621
Jul. 28, 2020 (KR) ..... 10-2020-0093771

(51) Int. Cl.
*A47L 9/04* (2006.01)
*A47L 9/02* (2006.01)

(52) U.S. Cl.
CPC ..... *A47L 9/0466* (2013.01); *A47L 9/02* (2013.01)

(58) Field of Classification Search
CPC ..... A47L 9/02; A47L 9/0466
USPC ..... 15/421
See application file for complete search history.

(56) References Cited

U.S. PATENT DOCUMENTS 1,468,467 A * 9/1923 Farnsworth ..... A47L 9/02 15/421
4,198,727 A * 4/1980 Farmer ..... A47L 9/06 15/396
4,355,436 A * 10/1982 Hertzberg ..... A47L 5/30 15/368
4,854,006 A * 8/1989 Nishimura ..... A47L 9/0455 15/375
5,249,331 A * 10/1993 Mitani ..... A47L 5/30 15/375
6,058,561 A 5/2000 Song et al.
6,381,802 B2 * 5/2002 Park ..... A47L 9/06 15/325

(Continued)

FOREIGN PATENT DOCUMENTS

CN 2273166 Y 1/1998
CN 109480716 A 3/2019

(Continued)

OTHER PUBLICATIONS

International Search Report and Written Opinion dated Nov. 17, 2020 from International Application No. PCT/KR2020/010794, 11 pages.

(Continued)

*Primary Examiner* — Bryan R Muller
(74) *Attorney, Agent, or Firm* — STAAS & HALSEY LLP

(57) ABSTRACT

A cleaner head is provided. The cleaner head includes: a nozzle; a case disposed close to an inlet of the nozzle; and a brush rotatably disposed in the case, wherein the case includes an air passage groove disposed in an outer side surface of the case and having a passage formed for the air to flow from an edge region of the case toward a surface to-be-cleaned.

12 Claims, 24 Drawing Sheets

(56) References Cited

U.S. PATENT DOCUMENTS

| | | | | |
|---|---|---|---|---|
| 6,514,356 | B2 * | 2/2003 | Vystrcil | A47L 9/062 15/373 |
| 7,134,164 | B2 | 11/2006 | Alton | |
| 7,290,309 | B2 * | 11/2007 | Rocke | A47L 9/06 15/364 |
| 9,149,169 | B2 * | 10/2015 | Patel | A47L 9/02 |
| 10,980,383 | B2 | 4/2021 | Zhu et al. | |
| 10,980,938 | B2 | 4/2021 | Zhu et al. | |
| 2005/0050680 | A1 * | 3/2005 | Anderson | A47L 9/242 15/415.1 |
| 2007/0113373 | A1 * | 5/2007 | Hato | A47L 9/04 15/354 |
| 2012/0167333 | A1 | 7/2012 | Hawkins et al. | |
| 2018/0255992 | A1 | 9/2018 | Isley et al. | |
| 2019/0167052 | A1 * | 6/2019 | Lee | A47L 9/0027 |

FOREIGN PATENT DOCUMENTS

| | | |
|---|---|---|
| GB | 2550180 | 11/2017 |
| JP | 9-51865 | 2/1997 |
| JP | 2000-107097 | 4/2000 |
| JP | 2002-143047 | 5/2002 |
| JP | 4497770 | 7/2010 |
| JP | 2013-59527 | 4/2013 |
| JP | 2019-514661 | 6/2019 |
| KR | 10-1995-0013450 | 6/1995 |
| KR | 1998-047183 | 9/1998 |
| KR | 2001-0055314 | 7/2001 |
| KR | 10-1004544 | 1/2011 |
| KR | 10-1018971 | 3/2011 |
| KR | 10-1944941 | 2/2019 |
| KR | 10-2061535 | 1/2020 |

OTHER PUBLICATIONS

Extended European Search Report dated Dec. 22, 2020 from European Patent Application No. 20190989.2, 6 pages.

Office Action dated Oct. 30, 2023, in Chinese Patent Application No. 202010822473.5.

* cited by examiner

CLEANER HEAD AND VACUUM CLEANER HAVING THE SAME

CROSS-REFERENCE TO RELATED APPLICATION(S)

This application is based on and claims priority under 35 U.S.C. § 119 to Korean Patent Application 10-2019-0099621, filed on Aug. 14, 2019, and Korean Patent Application 10-2020-0093771, filed on Jul. 28, 2020, in the Korean Intellectual Property Office, the contents of all of which are incorporated by reference herein in their entireties.

BACKGROUND OF THE DISCLOSURE

Field

Apparatuses and methods consistent with the disclosure relate to a cleaner head having improved suction efficiency and a vacuum cleaner having the same.

Description of the Related Art

A vacuum cleaner is a device that performs cleaning by sucking a foreign material including dust together with the air by generating suction power, and then removing the foreign material using a dust collector or the like.

The vacuum cleaner may suck the foreign material including the dust through a cleaner head making contact with a dusted and surface to-be-cleaned. However, suction on a corner between wall surfaces is not smooth due to shape and volume of the cleaner head itself.

SUMMARY OF THE DISCLOSURE

Embodiments of the disclosure overcome the above disadvantages and other disadvantages not described above. In addition, the disclosure is not required to overcome the disadvantages described above, and an embodiment of the disclosure may not overcome any of the problems described above.

The disclosure provides a cleaner head having improved suction efficiency and a vacuum cleaner having the same.

According to an embodiment of the disclosure, a cleaner head may include a case including a nozzle connection portion, and an air passage groove disposed on an exterior side surface of the case, extending from a first edge region of the exterior side surface to a second edge region of the exterior side surface, and configured to allow air to flow along the air passage groove from the first edge region to the second edge region to a surface to-be-cleaned; and a brush rotatably disposed in an interior of the case and configured to rotate to move material from the surface to-be-cleaned into the case, to thereafter be provided to the nozzle connection portion.

The air passage groove may decrease in width toward the second edge region.

The air passage groove may include: a first air passage groove having a first cross-sectional area and extending toward the second edge region; and a second air passage groove connected to the first air passage groove and having a second cross-sectional area greater than the first cross-sectional area and extending toward the first edge region.

A second width of the second air passage groove may be greater than a first width of the first air passage groove.

The width of the second air passage groove may become smaller as the second air passage groove extends toward the first air passage groove from the first edge region.

The air passage groove may be formed to have a predetermined width from the first edge region to the second edge region.

The air passage groove may be disposed at a position corresponding to a position at which a rotating shaft of the brush is disposed.

The case may include: a main case including a shielding surface connected to the brush and disposed to extend forward past an outer region of the brush; and a side case connected to the main case and having the air passage groove formed on an exterior side surface of the side case.

The shielding surface may be disposed in a direction parallel to the rotating shaft of the brush and disposed to protrude most from the case toward a front of the cleaner head.

The shielding surface may have a predetermined area or more to make surface contact with a wall surface perpendicular to the surface to-be-cleaned.

The shielding surface may be made of an elastic material.

The main case may include: a first main case disposed to expose a portion of the brush; and a second main case connected to the first main case and having a fixing hole to which the rotating shaft of the brush is fixed.

The side case may be connected to the second main case to cover the fixing hole, and the air passage groove may be formed toward an exposed region of the brush.

The side case may include a side surface positionable to be perpendicular to the surface to-be-cleaned, and the air passage groove may be formed on the exterior of the side surface.

The case may be configured so that, while the side surface makes contact with a wall surface, a passage enclosed by the air passage groove and the wall surface may be formed.

The side case may include bristles adjacent to the brush and arranged along a bottom edge of the side case.

The second edge region may be formed toward the bristles.

According to another embodiment of the disclosure, a cleaner head may include: a case including a nozzle connection portion, and an air passage formed at each of opposite side ends of a front surface of the case and configured to allow air to flow from above the case toward a surface to-be-cleaned; a brush rotatably disposed in an interior of the case and configured to rotate to move material from the surface to-be-cleaned into the case, to thereafter be provided to the nozzle connection portion.

The case may include: a main case including a shielding surface connected to the brush and formed to extend forward than an outer circumferential surface of the brush; and a side case installed on a side of the main case and forming a step with the front surface of the main case, wherein the air passage may be formed by the step between the front surface of the main case and the side case.

The side case may include bristles adjacent to the brush and arranged along an edge of a bottom surface of the side case, and a lower air passage may be formed on the bottom surface of the side case along the bristles.

The side case may further include a sub lower air passage formed on one side of the lower air passage along the lower air passage.

The side case may further include a sub air passage formed on one side of the air passage along the air passage.

The case may be configured so that, while the cleaner head makes contact with a corner between wall surfaces including a front wall surface and a side wall surface, the shielding surface of the main case may be brought into contact with the front wall surface and a side surface of the side case may be brought into contact with the side wall surface, to form the air passage, together with the step between the front surface of the main case and the side case, and the surface to-be-cleaned on which the cleaner head is disposed and the side wall surface may form the lower air passage, together with the bristles arranged along the edge of the bottom surface of the side case, and the bottom surface of the side case.

According to another embodiment of the disclosure, a vacuum cleaner includes: a cleaner body; a nozzle connected to the cleaner body; and a cleaner head connected to the nozzle and including a case disposed close to an inlet of the nozzle and a brush rotatably disposed in the case, wherein the case is configured so that, while the cleaner head makes contact with a corner region between wall surfaces, an air passage through which air flows from above the case toward a surface to-be-cleaned is formed on an outer surface of the case.

The air passage may be formed by an air passage groove formed on an outer side surface of the case.

The air passage groove may be formed to be narrowed toward the surface to-be-cleaned from one side surface of the case.

The case may include: a main case connected to the brush; and a side case installed on a side of the main case and forming a step with a front surface of the main case, wherein the air passage may be formed by the step between the front surface of the main case and the side case.

The air passage groove may include: a first air passage groove having a first cross-sectional area and one end disposed toward the surface to-be-cleaned; and a second air passage groove connected to the first air passage groove and having a second cross-sectional area greater than the first cross-sectional area toward the one side surface of the case.

The second air passage groove may have a smaller width as it is closer to the first air passage groove from the one side surface of the case.

The case may include: a main case including a shielding surface connected to the brush and disposed to extend forward than the brush; and a side case connected to the main case and having the air passage groove formed in its outer side surface.

The shielding surface may be disposed in a direction parallel to a rotating shaft of the brush and disposed to protrude most from the case toward a front of the cleaner head.

The shielding surface may have a predetermined area or more to make surface contact with a wall surface perpendicular to the surface to-be-cleaned.

Additional and/or other aspects and advantages of the disclosure are set forth in part in the description which follows and, in part, are obvious from the description, or may be learned by practice of the disclosure.

BRIEF DESCRIPTION OF THE DRAWINGS

The above and/or other aspects of the disclosure are more apparent by describing certain embodiments of the disclosure with reference to the accompanying drawings, in which.

DETAILED DESCRIPTION OF THE EMBODIMENTS

To sufficiently understand configurations and effects of the disclosure, embodiments of the disclosure are described with reference to the accompanying drawings. However, the disclosure is not limited to the embodiments to be described below, but may be implemented in several forms and may be variously modified. A description for these embodiments is provided only to make the disclosure complete and allow those skilled in the art to which the disclosure pertains to completely recognize the scope of the disclosure. In the accompanying drawings, sizes of components may be enlarged as compared with actual sizes for convenience of explanation, and ratios of the respective components may be exaggerated or reduced.

It is to be understood that if one component is described as being "on" or "in contact with" another component, it may be in direct contact or connection with another component, or be in contact or connection with another component having other component interposed therebetween. To the contrary, if one component is described as being "directly on" or "in direct contact with" another component, it is to be understood that there is no other component interposed therebetween. Other expressions that describe the relationship between the components, for example, "between" and "directly between" may be interpreted in the same way.

Terms such as 'first', 'second' and the like, may be used to describe various components, but the components are not to be interpreted to be limited to the terms. These terms may be used to differentiate one component from other components. For example, a 'first' component may be named a 'second' component and the 'second' component may also be similarly named the 'first' component, without departing from the scope of the disclosure.

Singular forms are intended to include plural forms unless the context clearly indicates otherwise. It may be interpreted that terms "include", "have" or the like, specify the presence of features, numerals, steps, operations, components, parts or a combination thereof mentioned in the present specification, but do not preclude the addition of one or more other features, numerals, steps, operations, components, parts or a combination thereof.

Terms used in the embodiments of the disclosure may be interpreted as the same meanings as meanings that are generally known to those skilled in the art unless defined otherwise.

Hereinafter, a structure of a vacuum cleaner 1 according to an embodiment of the disclosure is described with reference to FIG. 1.

Figure 1:
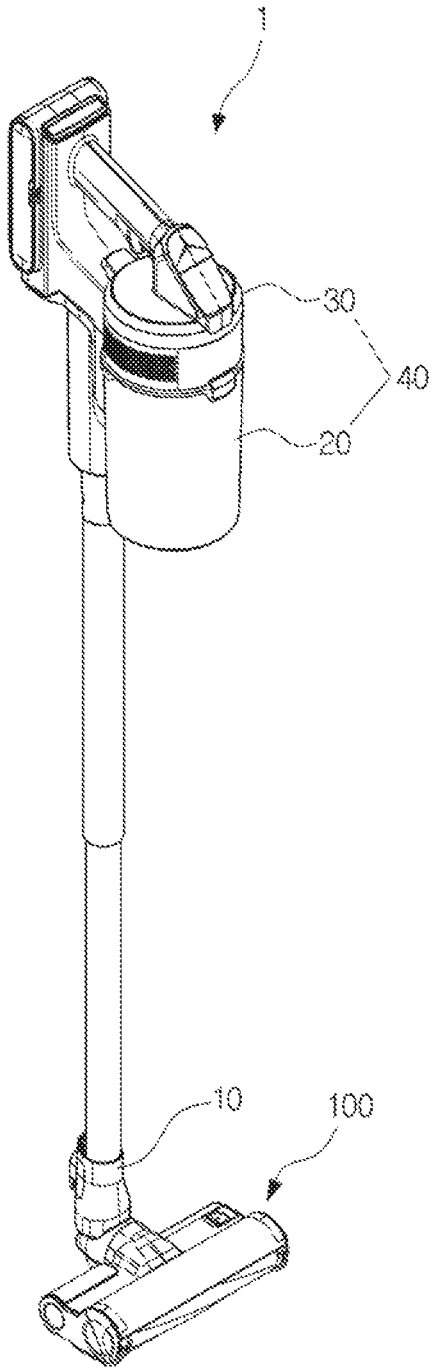
FIG. 1 is a perspective view of a vacuum cleaner according to an embodiment of the disclosure.

FIG. 1 is a perspective view of a vacuum cleaner 1 according to an embodiment of the disclosure.

The vacuum cleaner 1 may include a cleaner body 40 including a driver 30 configured to generate a suction force for sucking dust and a dust container 20 configured to collect sucked dust, a cleaner head 100 provided to suck foreign material from a surface to-be-cleaned S (see FIG. 8) by the suction force, and a nozzle 10 connecting the cleaner head 100 with the cleaner body 40.

The cleaner body 40 may be a wired type or a wireless type depending on a way how the driver 30 is operated.

For example, in case that the driver 30 is operated by an external power source connected by a cable, the vacuum cleaner 1 may be a wired vacuum cleaner. Meanwhile, in case that the driver 30 is operated by a battery (not shown) embedded in the cleaner body 40 without a cable, the vacuum cleaner 1 may be a wireless vacuum cleaner.

In addition, the cleaner body 40 may include a handle portion for user convenience, and the handle portion may have various shapes.

The dust container 20 may store dust sucked from the cleaner head 100. The dust container 20 may be detachably connected to the cleaner body 40 and may be separated therefrom for the user convenience.

The driver 30 is a device that generates suction power of the vacuum cleaner 1, and may include a motor (not shown) and a blade rotated by the motor.

The nozzle 10 may connect the cleaner head 100 with the cleaner body 40 to move the dust sucked from the cleaner head 100 to the cleaner body 40. The nozzle 10 may have various shapes as needed.

The cleaner head 100 may be provided to suck the foreign material such as dust on the surface to-be-cleaned while being moved in contact with the surface to-be-cleaned. A detailed structure of the cleaner head 100 is described below.

Hereinafter, the structure of the cleaner head 100 according to an embodiment of the disclosure is described with reference to FIGS. 2 to 4.

Figure 2:
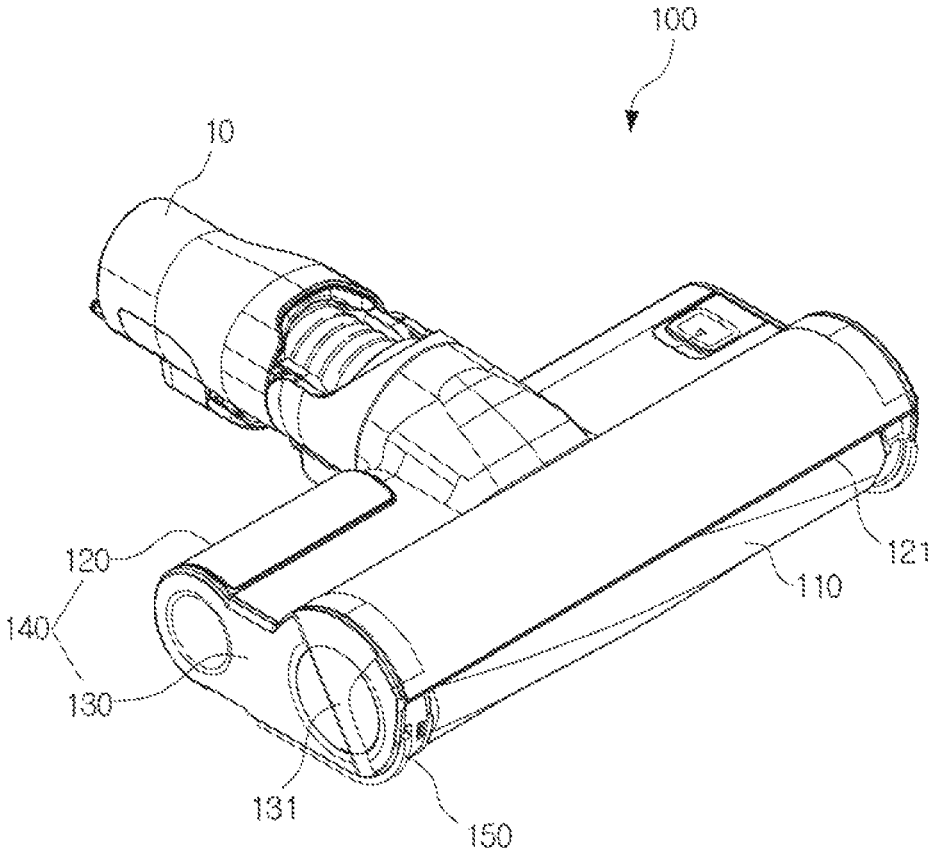
FIG. 2 is a perspective view of a cleaner head according to an embodiment of the disclosure.

FIG. 2 is a top perspective view of a cleaner head 100 according to an embodiment of the disclosure; FIG. 3 is a bottom perspective view of the cleaner head 100 according to an embodiment of the disclosure; and FIG. 4 is an exploded perspective view of the cleaner head 100 according to an embodiment of the disclosure.

As shown in FIG. 2, the cleaner head 100 may include: a case 140 disposed close to an inlet 11 of the nozzle 10; and a brush 110 rotatably disposed in the case 140.

The brush 110 may be rotatably disposed in the case 140, and thus be rotated in a predetermined direction. The brush 110 may have a cylindrical shape, and a material having high adhesion to the dust on the surface to-be-cleaned S may be disposed on an outer circumferential surface of the brush 110.

Accordingly, the suction force generated by the driver 30 acts and the brush 110 rotates simultaneously, so that the dust accumulated on the surface to-be-cleaned S may be moved toward the inlet 11 of the nozzle 10. That is, the brush 110 may sweep the dust accumulated on the surface to-be-cleaned S.

The brush 110 may have various shapes, and may be referred to as a brush drum or the like as needed.

In addition, a rotating shaft 111 of the brush 110 may be connected to a motor shaft 113*a* of a brush motor 113 embedded in the cleaner head 100 through a drive belt 112. Accordingly, a driving force of the motor shaft 113*a* rotated by an operation of the brush motor 113 may be transmitted to the brush 110 through the drive belt 112, and the brush 110 may be rotated in the predetermined direction.

Here, the predetermined direction may refer to a direction in which a bottom surface of the brush 110 is moved in a direction in which the inlet 11 of the nozzle 10 is disposed. Accordingly, as the brush 110 is rotated, the dust on the surface to-be-cleaned S may be guided to the inlet 11 by the rotation of the brush 110.

The case 140 may form an outer shape of the cleaner head 100, and may have a shape in which the case 140 is communicated with the outside only in a region adjacent to the brush 110. Accordingly, the case 140 may be communicated with the outside only in the predetermined region, thereby improving suction efficiency of the vacuum cleaner 1.

Figure 3:
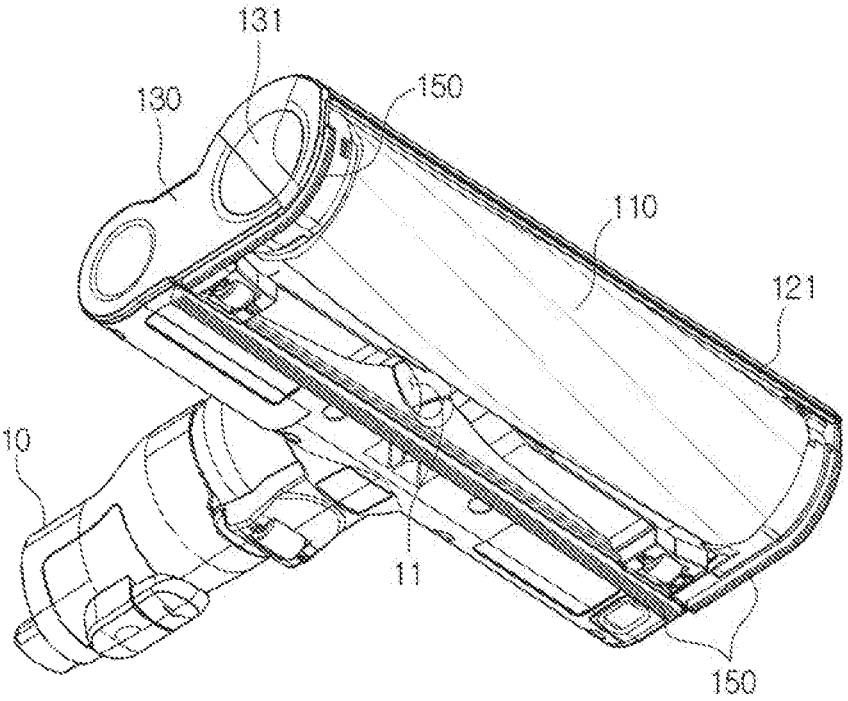
FIG. 3 is a bottom perspective view of the cleaner head according to an embodiment of the disclosure.
Figure 4:
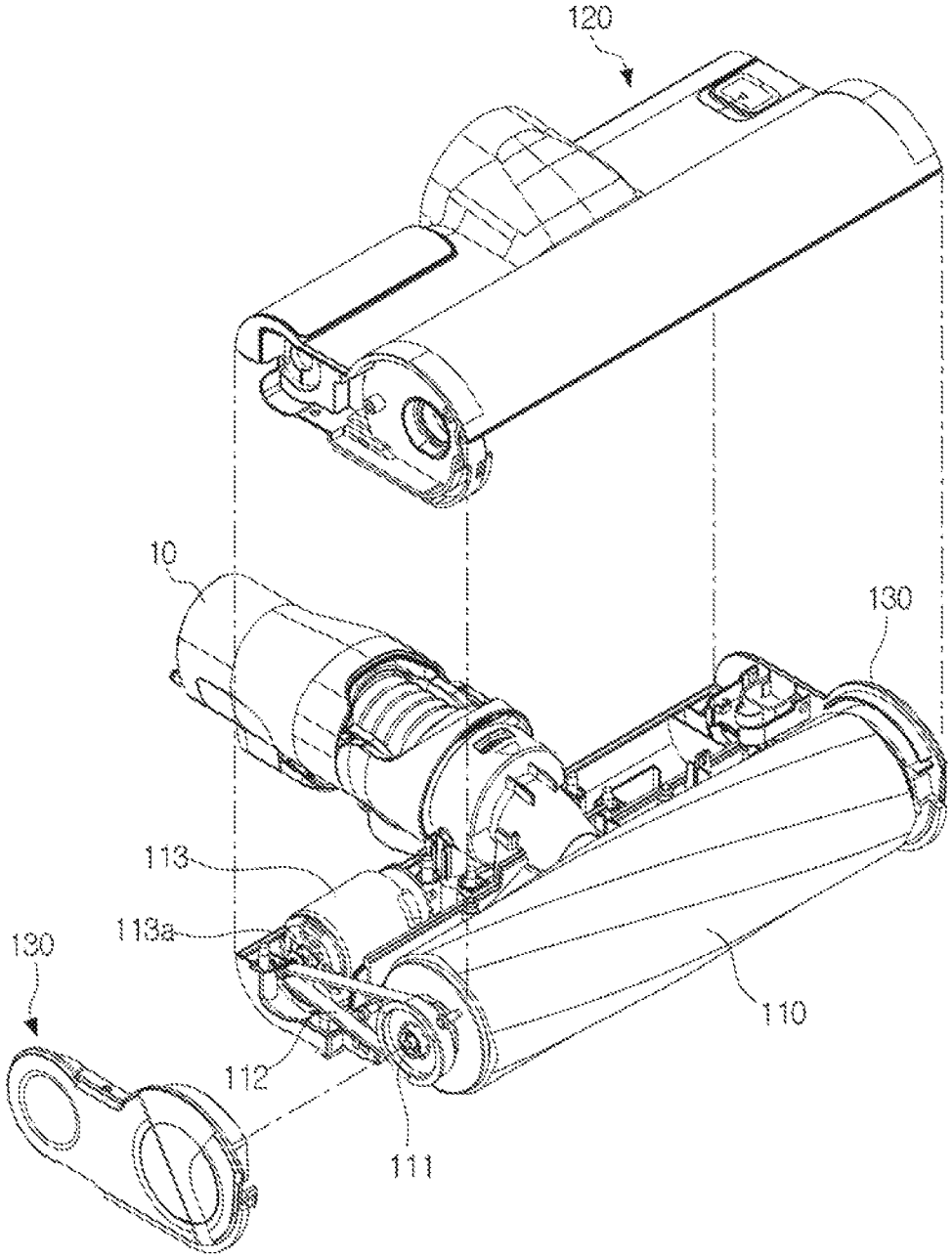
FIG. 4 is an exploded perspective view of the cleaner head according to an embodiment of the disclosure.

For example, as shown in FIG. 3, the case 140 may be provided to partially expose an outer circumferential surface of the brush 110. That is, the case 140 may be formed to expose a lower region of the brush 110 and a region adjacent to the inlet 11.

Accordingly, the dust on the surface to-be-cleaned S in contact with the exposed lower region of the brush 110 and the region adjacent to the inlet 11 may be sucked into the inlet 11.

In addition, the case 140 may include a main case 120 connected to the brush 110 and including a shielding surface 121 formed to extend forward than an outer region of the brush 110, and a side case 130 connected to the main case 120 and having an air passage groove 131 formed in its outer side surface.

The structures of the main case 120 and the side case 130 are described below.

Hereinafter, the structure of the main case 120 according to an embodiment of the disclosure is described with reference to FIGS. 5A and 5B.

Figure 5A:
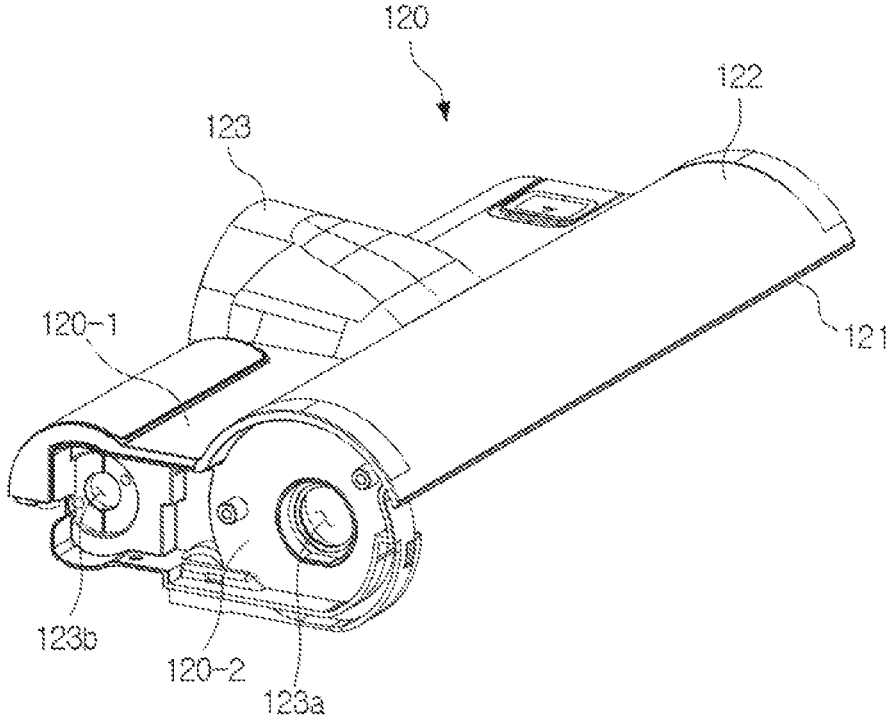
FIG. 5A is a perspective view of a main case according to an embodiment of the disclosure.
Figure 5B:
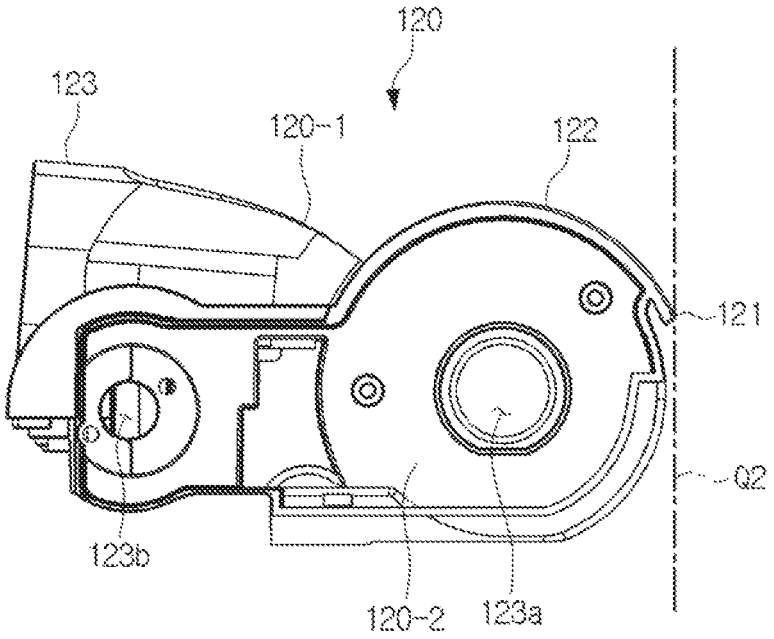
FIG. 5B is a side view of the main case according to an embodiment of the disclosure.

FIG. 5A is a perspective view of a main case 120 according to an embodiment of the disclosure, and FIG. 5B is a side view of the main case 120 according to an embodiment of the disclosure.

The main case 120 may include a first main case 120-1 disposed to expose a portion of the brush 110, and a second main case 120-2 connected to the first main case 120-1 and having a fixing hole 123*a* in which the rotating shaft 111 of the brush 110 is disposed.

The first main case 120-1 may cover a top side of the cleaner head 100, and may include a bent portion 122 having a shape corresponding to that of the brush 110, a nozzle connection portion 123 connected to the nozzle 10, and the shielding surface 121 formed to extend from the bent portion 122.

The bent portion 122 may be spaced apart from the outer circumferential surface of the brush 110 and may cover a top region of the brush 110. Accordingly, the bent portion 122 may protect the rotated brush 110 from external impact. In addition, the bent portion 122 may be formed not to extend to the lower region of the brush 110 and thus expose the lower region of the brush 110. Therefore, the lower region of the brush 110 may be exposed through a front surface of the main case 120.

The nozzle connection portion 123 may have various shapes as long as the nozzle connection portion 123 connects the case 140 with the nozzle 10.

The shielding surface 121 may be formed to extend further forward than the brush 110 from the bent portion 122. For example, the shielding surface 121 may be disposed in a direction parallel to the rotating shaft 111 of the brush 110 and disposed to protrude most from the case 140 toward a front of the cleaner head 100.

Accordingly, in case that the cleaner head 100 makes contact with a front wall surface Q2, the shielding surface 121 of the cleaner head 100 may be brought into contact with the front wall surface Q2. For example, in case that the cleaner head 100 is moved toward the front wall surface Q2, the shielding surface 121 may first make contact with the front wall surface Q2.

In addition, the shielding surface 121 may have a predetermined area or more to make surface contact with the front wall surface Q2 of the surface to-be-cleaned S. For example, a contact surface in which the shielding surface 121 is in contact with the front wall surface Q2 may have the predetermined area or more.

Accordingly, in case that the shielding surface 121 makes contact with the front wall surface Q2, it is possible to reduce or prevent the air above the case 140 from being moved to a to-be-cleaned region C (see FIG. 8) under the shielding surface 121 through the shielding surface 121.

Therefore, the vacuum cleaner 1 may have improved suction efficiency with the same suction power due to sucking dust only in the to-be-cleaned region C substantially sealed from the outside. That is, the vacuum cleaner 1 may have the improved suction efficiency by reducing suction of outside air other than the air in the to-be-cleaned region C.

In addition, the shielding surface 121 may be made of an elastic material. Accordingly, in case that the shielding surface 121 makes contact with the front wall surface Q2, actual shielding efficiency of the to-be-cleaned region C may be improved.

In addition, the shielding surface 121 itself may not be limited to being made of the elastic material, and a separate elastic member may be coupled to the shielding surface 121.

The second main case 120-2 may cover a side surface of the cleaner head 100. That is, the first main case 120-1 may cover the top surface of the cleaner head 100, and the second main case 120-2 may cover the side surface of the cleaner head 100.

The second main case 120-2 may include: the fixing hole 123*a* into which the rotating shaft 111 of the brush 110 is inserted; and a motor shaft hole 123*b* into which the brush motor shaft 113*a* of the brush motor 113 is inserted.

Accordingly, the second main case 120-2 may support the rotating shaft 111 of the brush 110 and the brush motor shaft 113*a* of the brush motor 113 to allow the rotating shaft 111 of the rotated brush 110 and the brush motor shaft 113*a* of the brush motor 113 to be stably rotated.

In addition, the second main case 120-2 may form an inner space in which the drive belt 112 is disposed together with the side case 130 coupled to the second main case 120-2, thereby protecting the drive belt 112 from the external impact and preventing the foreign material from being introduced into the drive belt 112.

In addition, the second main case 120-2 may be integrally formed with the first main case 120-1. For example, the first main case 120-1 and the second main case 120-2 may be injection molded together.

Hereinafter, a structure of the side case 130 according to an embodiment of the disclosure is described with reference to FIG. 6.

Figure 6:
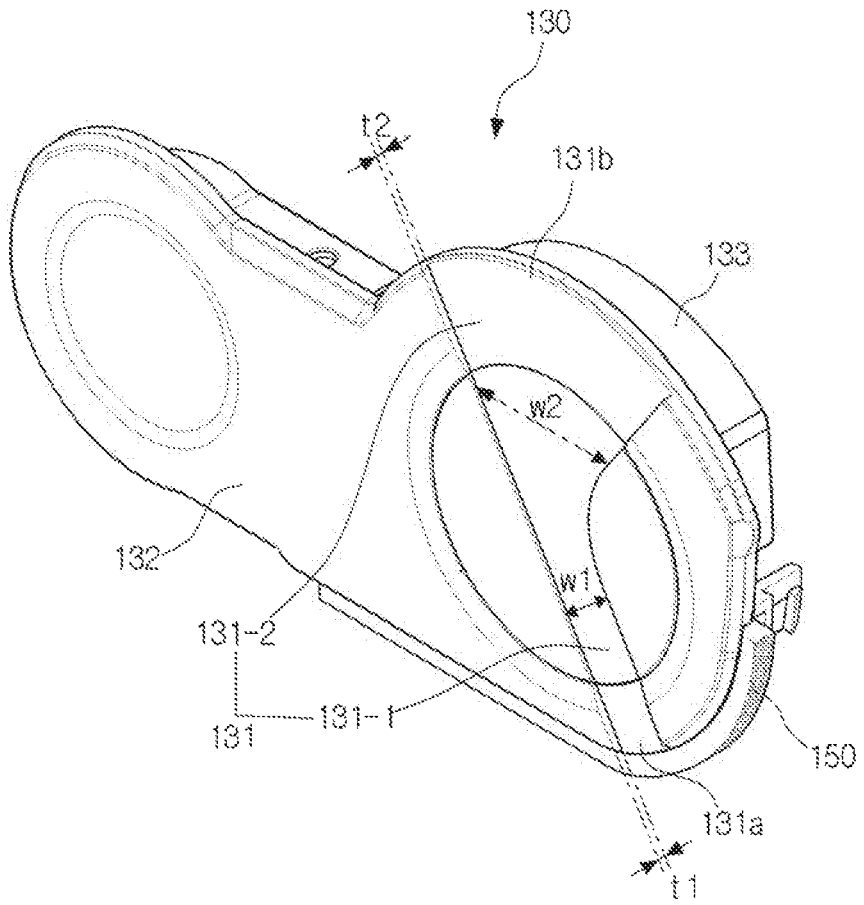
FIG. 6 is a perspective view of a side case according to an embodiment of the disclosure.

FIG. 6 is a perspective view of the side case 130 according to an embodiment of the disclosure.

The side case 130 may be connected to the second main case 120-2 to cover the fixing hole 123*a*. For example, the side case 130 may have a shape corresponding to that of the second main case 120-2, and may cover the fixing hole 123*a* and the motor shaft hole 123*b*.

In addition, the side case 130 may be disposed on each of both sides of the cleaner head 100. For example, the side case 130 may be connected to the second main case 120-2 through a connection portion 133 of the side case 130.

In addition, the side case 130 may include a side surface 132 perpendicular to the surface to-be-cleaned S and the air passage groove 131 disposed in the outer side surface 132 of the side case 130 and having a passage formed to be narrowed from an edge region 131*b* of the case 140 toward the surface to-be-cleaned S.

Here, the edge region 131*b* of the case 140 may refer to an edge region in which the side surface and a top surface of the case 140 are in contact with each other.

The side surface 132 may be a surface making contact with a side wall surface Q1, and may be formed to be flat. In addition, the air passage groove 131 may be formed in the side surface 132.

Accordingly, in case that the side surface 132 makes contact with the side wall surface Q1, the air outside the case 140 may be prevented from being moved on the side surface 132 and may be moved only through the air passage groove 131. For example, in case that the side surface 132 makes contact with the side wall surface Q1, a passage enclosed by the air passage groove 131 and the side wall surface Q1 may be formed.

Therefore, in case that the cleaner head 100 makes contact with the side wall surface Q1, the side surface 132 may improve flow efficiency of the air moved to the air passage groove 131 through surface contact of the cleaner head 100 with the side wall surface Q1.

The air passage groove 131 may be formed in the outer side surface 132 of the side case 130, and include one end 131*a* disposed toward the surface to-be-cleaned S and the other end 131*b* disposed toward the edge region of the case 140. That is, the air passage groove 131 may refer to one passage formed in the outer side surface 132 of the side case 130. Here, the other end 131*b* may be referred to the same as the edge region of the case 140.

Alternatively, the other end 131*b* may be various positions of the edge of the case 140.

Accordingly, the air passage groove 131 may introduce the air outside the case 140 and blow the introduced air to the to-be-cleaned region C by the suction force of the nozzle 10.

In addition, the air passage groove 131 may include a first air passage groove 131-1 having a first cross-sectional area and the one end 131*a* disposed toward the surface to-be-cleaned S and a second air passage groove 131-2 connected to the first air passage groove 131-1 and having a second cross-sectional area greater than the first cross-sectional area toward the edge region 131*b* of the case. That is, the first air passage groove 131-1 and the second air passage groove 131-2 may form one passage together.

Here, the first cross-sectional area may refer to a cross-sectional area of the groove of the first air passage groove 131-1, and may refer to an area having a first width w1 and a first depth t1. In addition, the second cross-sectional area may refer to a cross-sectional area of the groove of the second air passage groove 131-2, and may refer to an area having a second width w2 and a second depth t2.

In addition, the second width w2 of the second air passage groove 131-2 may be greater than the first width w1 of the first air passage groove 131-1. In addition, the second air passage groove 131-2 may have a smaller width as it is closer to the first air passage groove 131-1 from the edge region 131*b* of the case 140.

Accordingly, in case that the air is introduced from the outside of the case 140, the air moved from the second air passage groove 131-2 having the second cross-sectional area may pass through the first air passage groove 131-1 having the first cross-sectional area smaller than the second cross-sectional area, and may thus have an increased flow velocity.

Therefore, the air passed through the one end 131*a* of the first air passage groove 131-1 may flow rapidly into the to-be-cleaned region C, thereby improving the effect of blowing the air into the to-be-cleaned region C.

That is, the flow velocity of the air introduced from the outside of the case 140 may be increased even with the same suction force of the vacuum cleaner 1 through a structural shape in which the second air passage groove 131-2 has a smaller width as it is closer to the first air passage groove 131-1 from the edge region 131*b* of the case 140.

Accordingly, it is possible to blow the air at a high flow velocity into the dust in the to-be-cleaned region C where the suction force of the vacuum cleaner 1 fails to reach because the to-be-cleaned region C is adjacent to a corner between the wall surfaces. Then, the dust in the to-be-cleaned region C may be scattered within the to-be-cleaned region C by the air, and the scattered dust may be sucked into the nozzle 10 through the suction force of the vacuum cleaner 1 and the brush 110.

In addition, a cross section of the air passage groove 131 may have various shapes as needed.

In addition, the first air passage groove 131-1 and the second air passage groove 131-2 may have the same depth. For example, the first depth t1 and the second depth t2 may be the same. However, if necessary, the first depth t1 and the second depth t2 may be formed differently from each other.

In addition, the air passage groove 131 may be disposed at a position corresponding to a position at which the rotating shaft 111 of the brush 110 is disposed. In addition, the air passage groove 131 may be formed toward an exposed region of the brush 110.

Here, the exposed region of the brush 110 may refer to a portion of the brush 110 that is not covered by the case 140.

Accordingly, the one end 131*a* of the air passage groove 131 may be disposed adjacent to a front bottom portion of the brush 110, and simultaneously, the air passage groove 131 may be formed in the shortest length, thereby preventing the flow velocity of the air introduced from the outside of the case 140 from being reduced due to friction and the like.

In addition, the air passage groove 131 may be operated only in case that the side surface 132 makes contact with the side wall surface Q1. For example, in case that the side surface 132 is not in contact with the side wall surface Q1, an air flow having a predetermined speed or higher may not be formed by the air passage groove 131. Accordingly, the air passage groove 131 may be operated in case that the cleaner head 100 is disposed at the corner region between the wall surfaces, thereby improving the suction efficiency of the vacuum cleaner 1 when cleaning a normal flat surface.

In addition, referring to FIG. 6, the side case 130 may include bristles 150 adjacent to the brush 110 and arranged along a bottom edge of the side case 130.

The bristles 150 may improve cleaning efficiency of the vacuum cleaner 1 by making contact with the surface to-be-cleaned S to sweep the dust accumulated on the surface to-be-cleaned S or allow the dust to be first attached thereto and then the attached dust to be sequentially sucked into the vacuum cleaner 1.

In addition, the bristles 150 may improve shielding effect of the to-be-cleaned region C by making contact with the surface to-be-cleaned S and with the front wall surface Q2.

In addition, the one end 131*a* of the air passage groove 131 may be formed toward the bristles 150. Accordingly, in case that the dust is attached to and accumulated on the bristles 150, the air introduced through the air passage groove 131 may shake the dust from the bristles 150 and scatter the dust within the to-be-cleaned region C, thereby improving the cleaning efficiency of the vacuum cleaner 1.

In addition, as shown in FIG. 3, the bristles 150 may be arranged along a bottom edge of the case 140, adjacent to the surface to-be-cleaned S. However, the bristles 150 is not limited to improving the cleaning efficiency of the vacuum cleaner 1, and may be made of various materials such as the elastic material, a plastic injection material, and a sealing member to implement the shielding effect of the to-be-cleaned region C.

Hereinafter, operations of the cleaner head 100 and the vacuum cleaner 1 according to an embodiment of the disclosure are described with reference to FIGS. 7 to 9.

Figure 7:
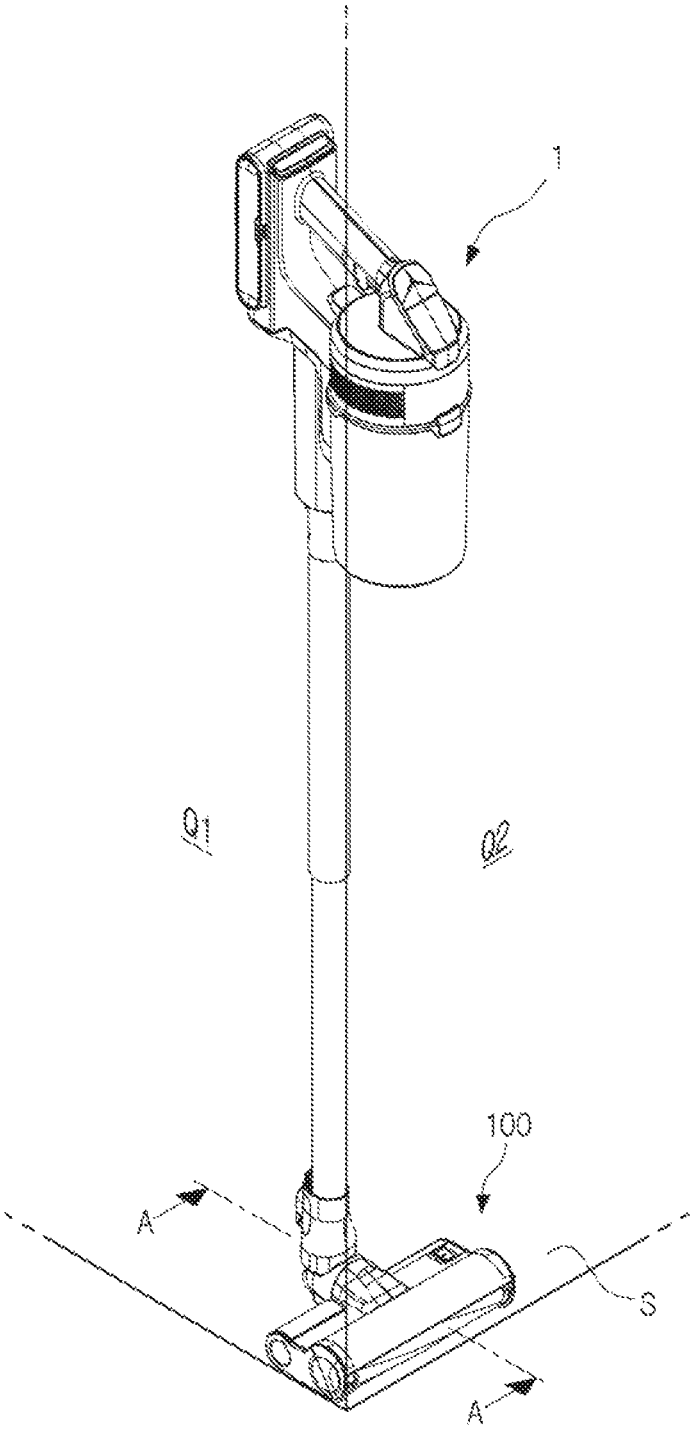
FIG. 7 is a schematic view showing a state in which the vacuum cleaner according to an embodiment of the disclosure is disposed at a corner between wall surfaces.
Figure 8A:
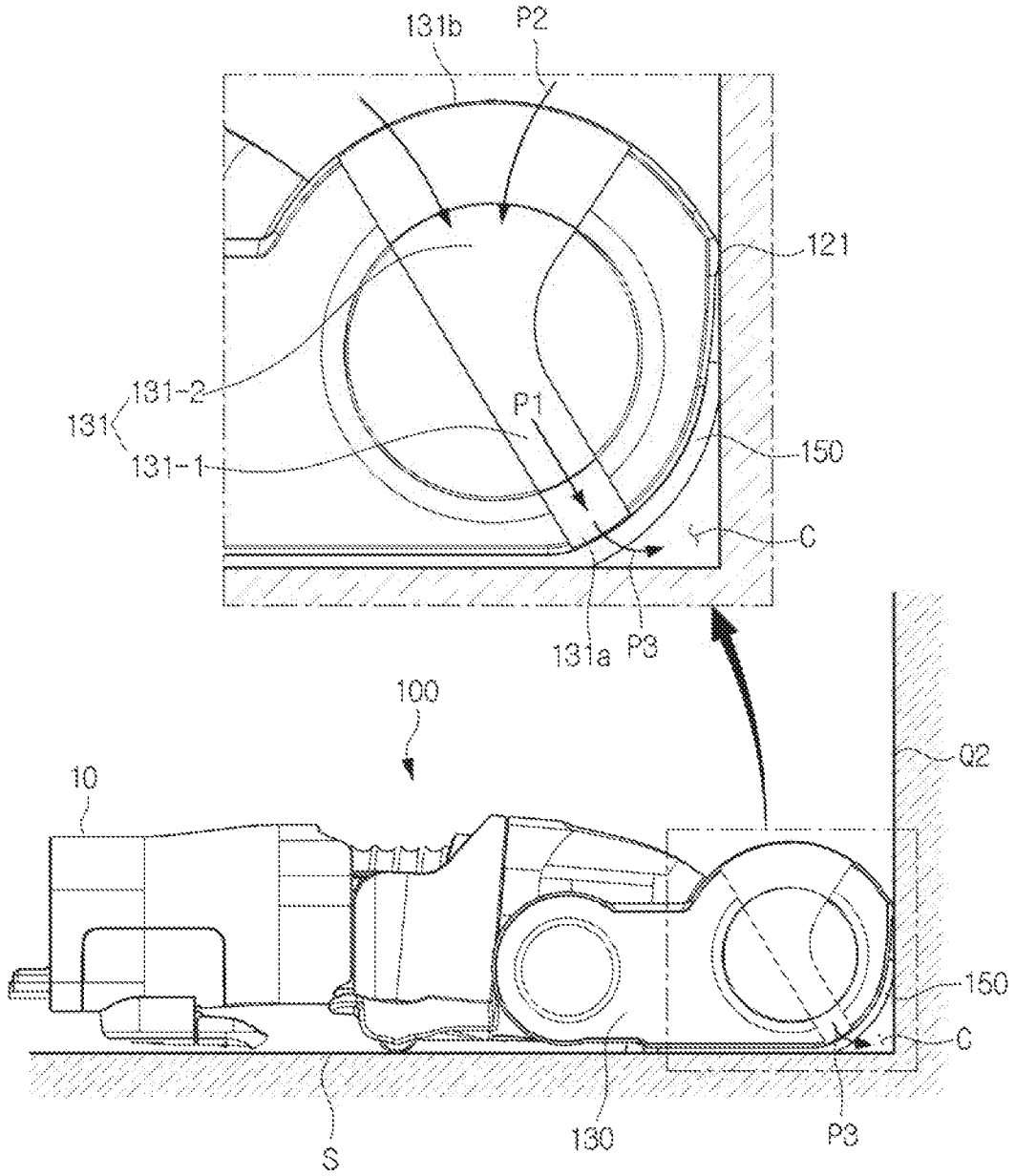
FIG. 8A is a side view of a portion of FIG. 7.
Figure 8B:
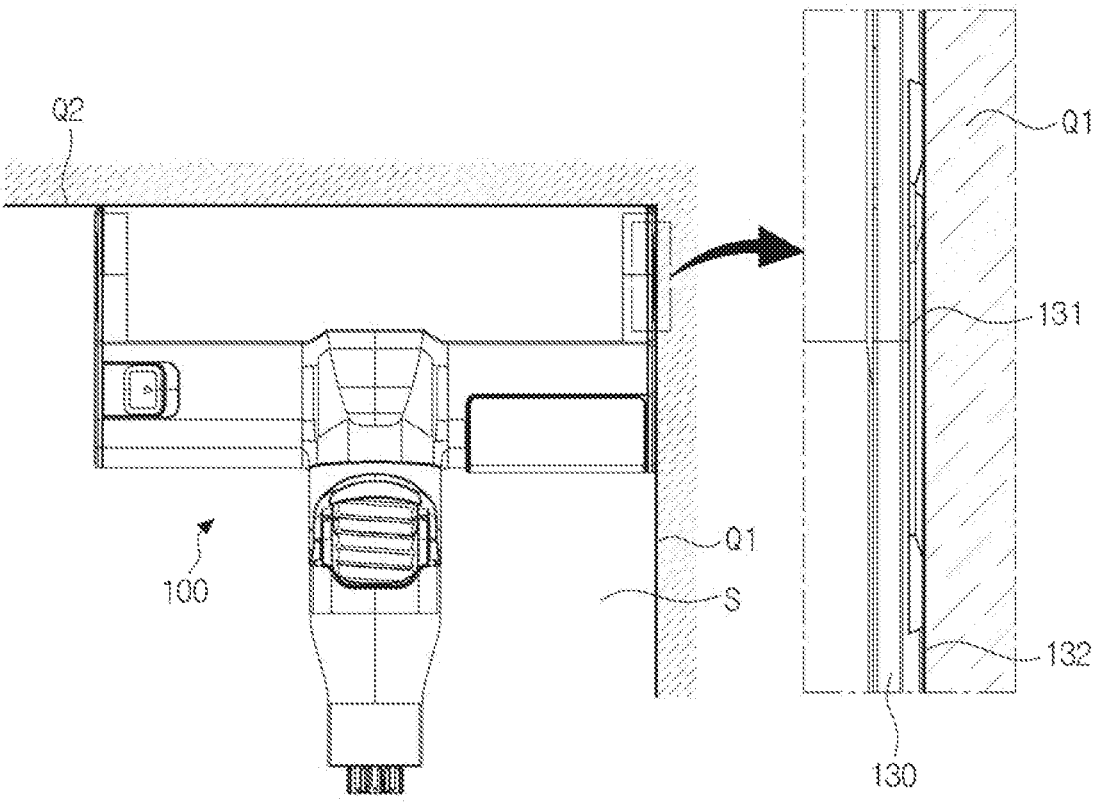
FIG. 8B is a plan view of the portion of FIG. 7.

FIG. 7 is a schematic view showing a state in which the vacuum cleaner 1 according to an embodiment of the disclosure is disposed at a corner between wall surfaces; FIG. 8A is a side view of a portion of FIG. 7; FIG. 8B is a top view of the portion of FIG. 7; and FIG. 9 is a cross-sectional view taken along line A-A of FIG. 7.

As shown in FIG. 7, the cleaner head 100 of the vacuum cleaner 1 may be disposed at a corner region between the wall surfaces to clean a corner portion between the wall surfaces.

Here, the corner region between the wall surfaces may be formed of the surface to-be-cleaned S which is a floor, the side wall surface Q1 and the front wall surface Q2. In addition, the side wall surface Q1 may refer to a wall surface facing the side case 130 of the cleaner head 100, and the front wall surface Q2 may refer to a wall surface facing the shielding surface 121.

In addition, as shown in FIG. 8A, the case 140 may make contact with the front wall surface Q2, and thereby the cleaner head 100 may form the to-be-cleaned region C which is a space between the surface to-be-cleaned S and the front wall surface Q2.

In detail, the shielding surface 121 of the cleaner head 100 may make contact with the front wall surface Q2, and then the shielding surface 121 may prevent the air outside the case 140 from being introduced into the to-be-cleaned region C.

Accordingly, the suction force of the vacuum cleaner 1 may not be used to introduce the air outside the case 140 and may be used to suck the dust in the to-be-cleaned region C. Therefore, the suction force may not be wasted, thereby improving the suction efficiency of the vacuum cleaner 1.

In addition, as shown in FIG. 8B, the side case 130 may make contact with the side wall surface Q1. In detail, the side surface 132 of the side case 130 may make contact with the side wall surface Q1.

Accordingly, the air outside the case 140 may be prevented from being introduced through the side surface 132 of the side case 130, and may be introduced into the to-be-cleaned region C only through the air passage groove 131 formed in the side case 130.

In detail, as shown in FIG. 8A, as the vacuum cleaner 1 disposed in the corner region between the wall surfaces is operated, the air outside the case 140 may be introduced into the air passage groove 131 by the suction force of the vacuum cleaner 1.

For example, the air outside the case 140 may form a second air flow P2 through the second air passage groove 131-2, and may form a first air flow P1 through the first air passage groove 131-1 connected to the second air passage groove 131-2.

Here, the first cross-sectional area of the first air passage groove 131-1 may be smaller than the second cross-sectional area of the second air passage groove 131-2, and a flow velocity of the first air flow P1 may be faster than a flow velocity of the second air flow P2.

Then, the first air flow P1 may form a third air flow P3 that is rapidly moved through the one end 131*a* adjacent to the to-be-cleaned region C, and the air in the third air flow P3 may scatter the dust accumulated in the corner region between the wall surfaces.

Figure 9:
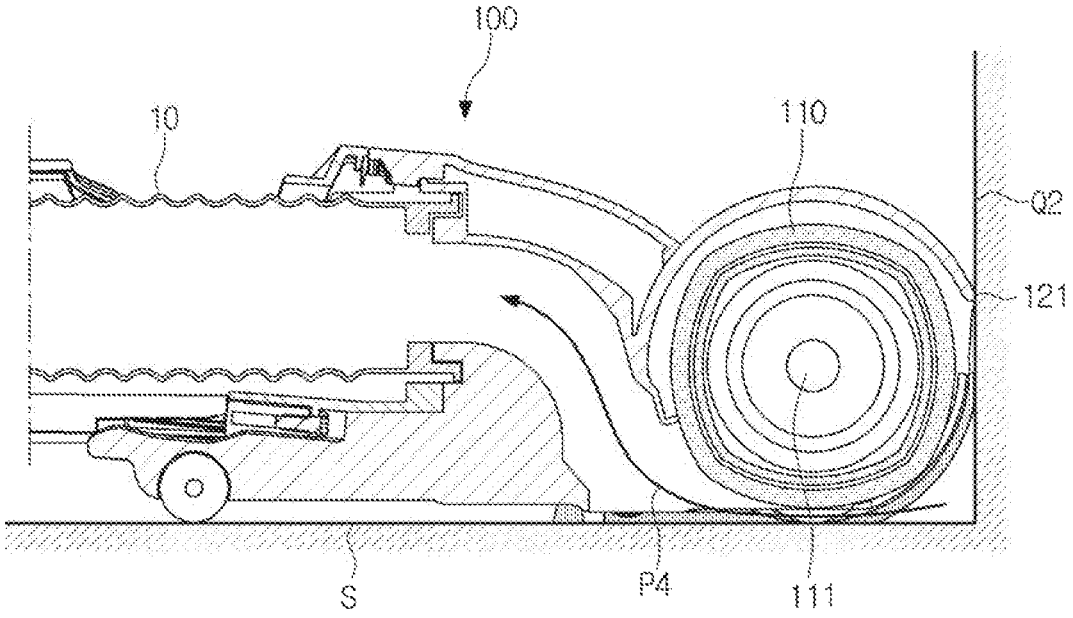
FIG. 9 is a cross-sectional view taken along line A-A of FIG. 7.

Next, as shown in FIG. 9, the scattered dust may be moved together with a fourth air flow P4 introduced into the nozzle 10, so that efficiency of removing the dust from the corner region between the wall surfaces may be significantly improved. That is, the air moved through the air passage groove 131 may remove the dust from the region where the brush 110 and the bristles 150 fail to sweep.

The above description describes the case where the air passage groove 131 formed in the one side surface of the case 140 of the cleaner head 100 has a narrower width toward the surface to-be-cleaned S. However, the air passage groove 131 may not be limited to this shape. As another example, as shown in FIG. 10, the air passage groove may be formed to have a constant width.

Figure 10:
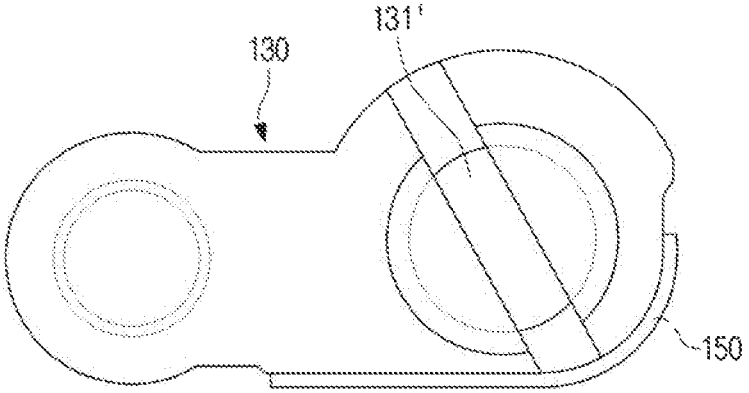
FIG. 10 is a view of an air passage groove of the side case according to an embodiment of the present disclosure.

FIG. 10 is a view showing another example of the air passage groove of the side case 130 according to an embodiment of the disclosure.

Referring to FIG. 10, an air passage groove 131' may be formed to have a constant width in the one side surface of the case 140 (see FIG. 2). The air passage groove 131' may be formed in the one side surface of the side case 130 to have the constant width from the edge region of the case 140 toward the surface to-be-cleaned S.

Accordingly, in case that the side case 130 of the cleaner head 100 makes contact with the side wall surface Q1 at the corner between the wall surfaces, the air passage groove 131' may form an air passage through which the air passes, together with the side wall surface Q1, and the air above the case 140 may flow into the corner region between the wall surfaces through the air passage groove 131' formed in the side case 130. Then, the dust in the corner region between the wall surfaces may be scattered and removed.

Hereinafter, a vacuum cleaner 1' according to another embodiment of the disclosure is described with reference to FIG. 11.

Figure 11:
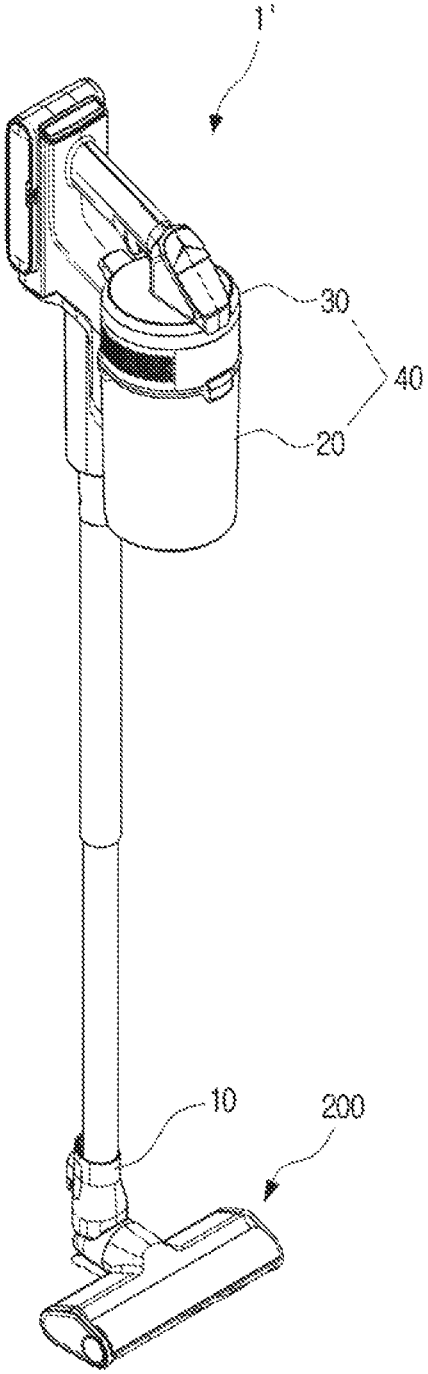
FIG. 11 is a perspective view of a vacuum cleaner according to another embodiment of the disclosure.

FIG. 11 is a perspective view of the vacuum cleaner 1' according to another embodiment of the disclosure.

The vacuum cleaner 1' may include a cleaner body 40 including a driver 30 generating a suction force for sucking dust and a dust container 20 collecting sucked dust, a cleaner head 200 provided to suck foreign material from a surface to-be-cleaned S (see FIG. 17) by suction force of the driver 30, and a nozzle 10 connecting the cleaner head 200 with the cleaner body 40.

The cleaner body 40 may be a wired type or a wireless type depending on a way how the driver 30 is operated.

For example, in case that the driver 30 is operated by an external power source connected by a cable, the vacuum cleaner 1' may be a wired vacuum cleaner. In addition, in case that the driver 30 is operated by a battery (not shown) embedded in the cleaner body 40 without a cable, the vacuum cleaner 1' may be a wireless vacuum cleaner.

In addition, the cleaner body 40 may include a handle portion for user convenience, and the handle portion may have various shapes.

The dust container 20 may store dust sucked from the cleaner head 200. The dust container 20 may be detachably disposed to the cleaner body 40, and may be separated from the cleaner body 40 to empty the dust collected therein.

The driver 30 is a device that generates suction force of the vacuum cleaner 1', and may include a motor (not shown) and a blade (not shown) rotated by the motor.

The nozzle 10 may connect the cleaner head 200 with the cleaner body 40 to move the dust sucked from the cleaner head 200 to the cleaner body 40. The nozzle 10 may have various shapes as needed.

The cleaner head 200 may be provided to suck the foreign material such as dust on the surface to-be-cleaned S while being moved in contact with the surface to-be-cleaned S. A detailed structure of the cleaner head 200 is described below.

Hereinafter, the cleaner head 200 according to another embodiment of the disclosure is described with reference to FIGS. 12 to 14.

Figure 12:
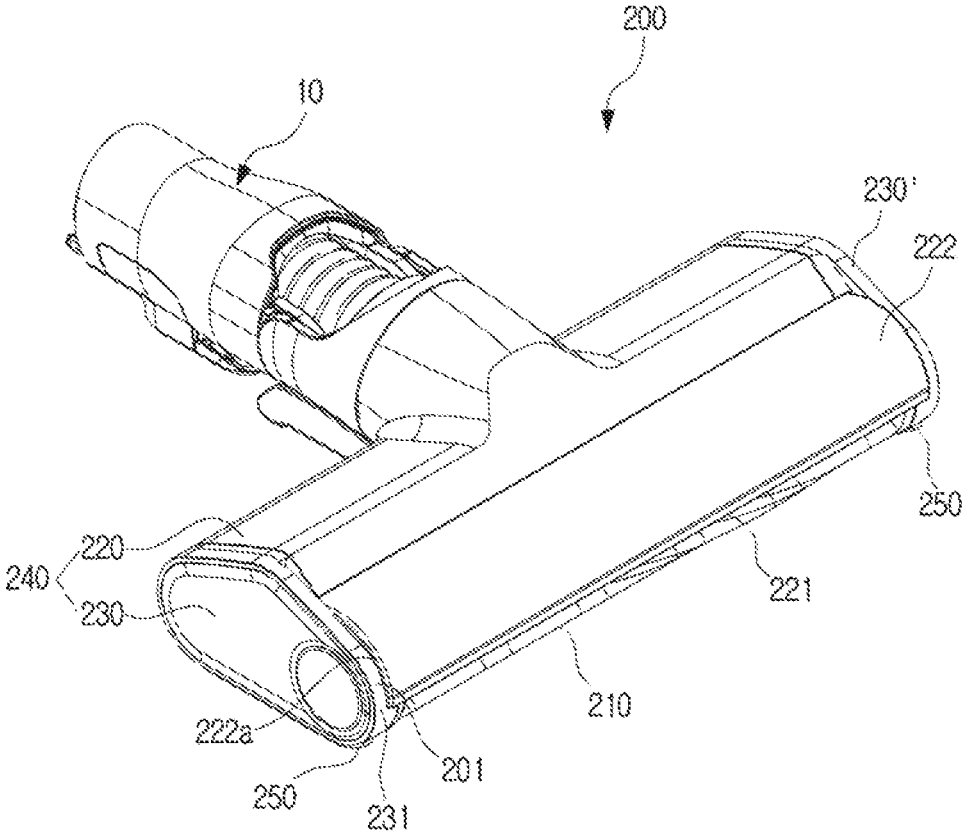
FIG. 12 is a perspective view of a cleaner head according to another embodiment of the disclosure.
Figure 13:
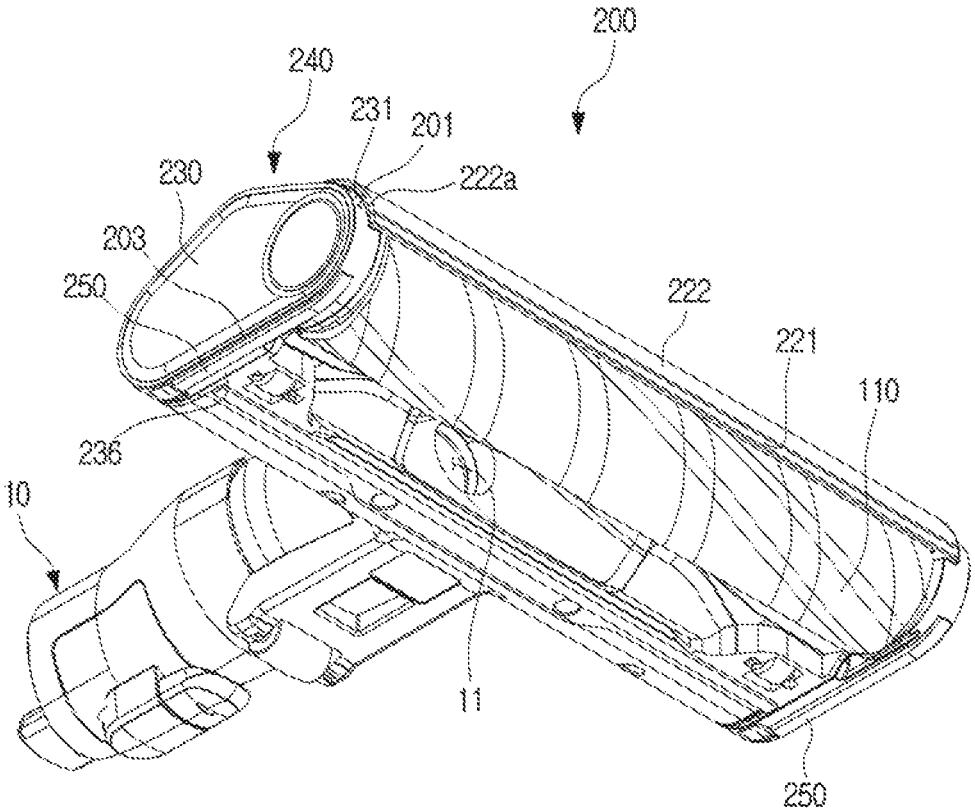
FIG. 13 is a bottom perspective view of the cleaner head according to another embodiment of the disclosure.
Figure 14:
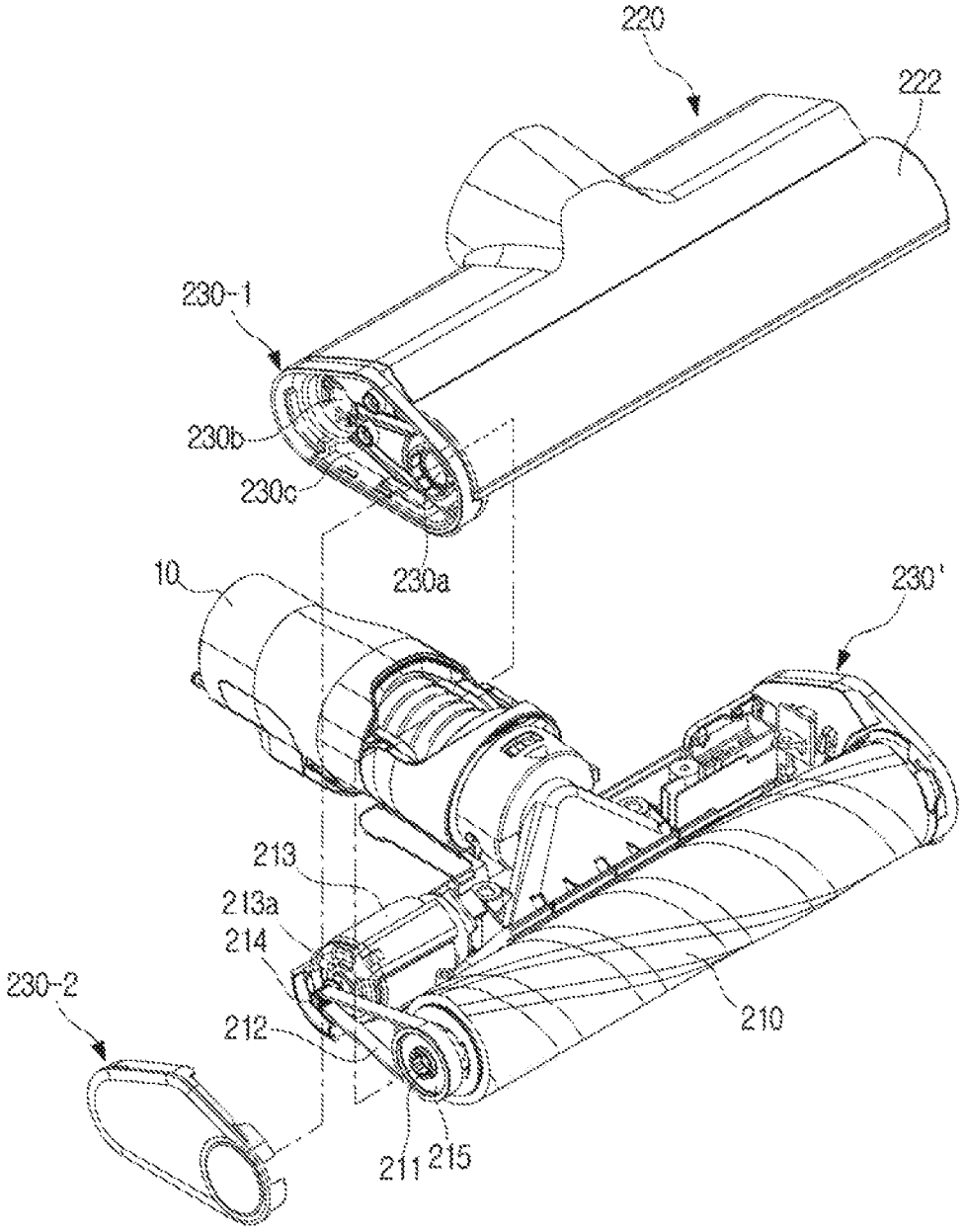
FIG. 14 is an exploded perspective view of the cleaner head according to another embodiment of the disclosure.

FIG. 12 is a perspective view of the cleaner head 200 according to another embodiment of the disclosure, FIG. 13 is a bottom perspective view of the cleaner head 200 according to another embodiment of the disclosure, and FIG. 14 is an exploded perspective view of the cleaner head 200 according to another embodiment of the disclosure.

As shown in FIGS. 12 and 13, the cleaner head 200 may include a case 240 disposed close to an inlet 11 of the nozzle 10 and a brush 210 rotatably disposed in the case 240.

The brush 210 may be rotatably disposed inside the case 240, and thus be rotated in a predetermined direction. The brush 210 may have a cylindrical shape and a material having high adhesion to the dust on the surface to-be-cleaned S may be disposed on its outer circumferential surface.

Accordingly, the brush 210 may be rotated at the same time as the dust is sucked by the suction force generated by the driver 300, so that the dust on the surface to-be-cleaned S may be moved toward the inlet 11 of the nozzle 10. That is, the brush 210 may sweep the dust on the surface to-be-cleaned S.

The brush 210 may have various shapes, and may be referred to as a brush drum or the like as needed.

In addition, a rotating shaft 211 of the brush 210 may be connected to a motor shaft 213*a* of a brush motor 213 embedded in the cleaner head 200 through a drive belt 212 and pulleys 214 and 215. Accordingly, a driving force of the motor shaft 213*a* rotated by an operation of the brush motor 213 may be transmitted to the brush 210 through the drive belt 212 and the pulleys 214 and 215, and the brush 210 may be rotated in the predetermined direction.

Here, the predetermined direction may refer to a direction in which a bottom surface of the brush 210, which is in contact with the surface to-be-cleaned S, is moved in a direction in which the inlet 11 of the nozzle 10 is disposed. Accordingly, as the brush 210 is rotated, the dust on the surface to-be-cleaned S may be moved toward the inlet 11 by the rotation of the brush 210.

The case 240 may form an outer shape of the cleaner head 200, and have an open bottom for the brush 210 to be disposed therein.

For example, as shown in FIG. 13, the case 240 may be formed to expose a portion of an outer circumferential surface of the brush 210. In detail, the case 240 may have the open bottom to expose a lower region of the brush 210 and a region adjacent to the inlet 11.

Accordingly, the dust on the surface to-be-cleaned S in contact with the exposed lower region of the brush 210 and the region adjacent to the inlet 11 may be sucked into the inlet 11.

In addition, a front surface of the case 240 may be partially open. That is, a lower end of the front surface of the case 240 may be formed to be spaced apart by a predetermined distance from the surface to-be-cleaned S. Therefore, a lower front portion of the brush 210 may be exposed through the front surface of the case 240.

In addition, the case 240 may include an air passage 201 formed at each of opposite side ends of the front surface of the case 240 and allowing air to flow from above the case 240 to below the case 240, that is, toward the surface to-be-cleaned S. Therefore, in case that the front surface of the case 240 makes contact with the wall surface, the outside air may flow to the surface to-be-cleaned S along the air passage 201 of the case 240.

The case 240 may include a main case 220 connected to the brush 210 and including a shielding surface 221 formed to extend forward than the brush 210, and a side case 230 installed at the main case 220 and forming the air passage 201.

Hereinafter, the main case 220 according to an embodiment of the disclosure is described with reference to FIG. 15.

Figure 15:
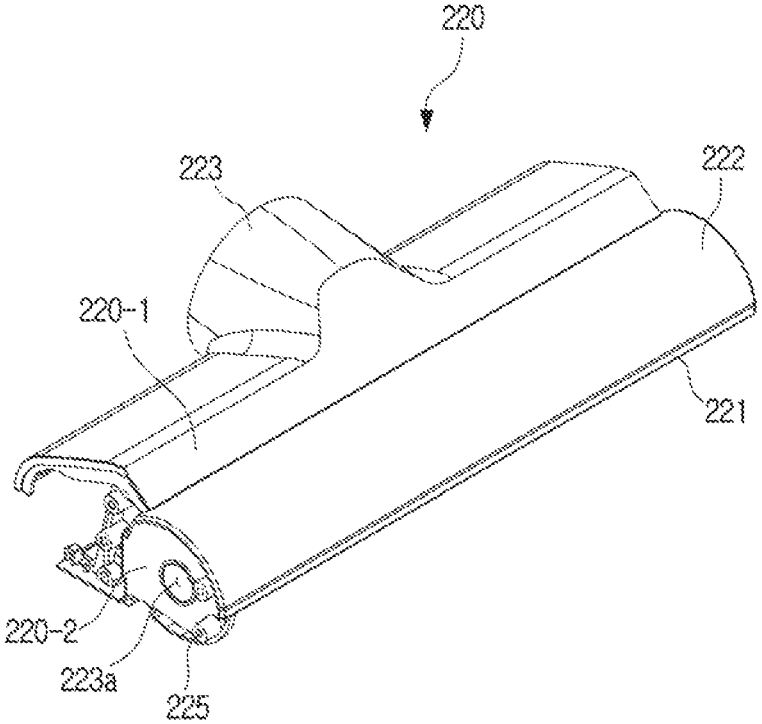
FIG. 15 is a perspective view of a main case according to another embodiment of the disclosure.

FIG. 15 is a perspective view of a main case 220 according to an embodiment of the disclosure.

The main case 220 may include a first main case 220-1 disposed to expose a portion of the brush 210 and a second main case 220-2 connected to the first main case 220-1 and having a fixing hole 223*a* into which the rotating shaft 211 of the brush 210 is inserted.

The first main case 220-1 may form a top surface of the cleaner head 200, and may include a bent portion 222 having a shape corresponding to that of the brush 210, a nozzle connection portion 223 connected to the nozzle 10, and the shielding surface 221 formed to extend from the bent portion 222.

The bent portion 222 may be spaced apart from the outer circumferential surface of the brush 210 and may cover a top region of the brush 210. Accordingly, the bent portion 222 may protect the rotated brush 210 from external impact. In addition, the bent portion 222 may be formed not to extend to the lower region of the brush 210 for the lower region of the brush 210 to be exposed.

The nozzle connection portion 223 may be formed to connect the case 240 with the nozzle 10, and have various shapes as long as the nozzle connection portion 223 can connect the case 240 with the nozzle 10.

The shielding surface 221 may be formed to extend forward than the brush 210 from the bent portion 222. For example, the shielding surface 221 may have the same length as the bent portion 222, be disposed in a direction parallel to the rotating shaft 211 of the brush 210 and protrude most from the case 240 toward a front of the cleaner head 200.

A lower end of the shielding surface 221 may be disposed at approximately the same level as the rotating shaft 211 of the brush 210. The case 240 is opened under shielding surface 221, so that the lower region of the brush 210 may be exposed. That is, when viewed from the front of the cleaner head 200, the lower region of a front surface of the brush 210 may be seen under the shielding surface 221. Therefore, the suction force of the vacuum cleaner 1' may not be applied in front of the brush 210.

In case that the cleaner head 200 makes contact with a front wall surface Q2, the shielding surface 221 of the cleaner head 200 may be brought into contact with the front wall surface Q2. For example, in case that the cleaner head 200 is moved toward the front wall surface Q2, the shielding surface 221 may be first brought into contact with the front wall surface Q2.

In addition, the shielding surface 221 may have a predetermined area or more to make surface contact with the front wall surface Q2. For example, the shielding surface 221 may be formed to have a length corresponding to that of the bent portion 222 and a predetermined width.

Accordingly, in case that the shielding surface 221 makes contact with the front wall surface Q2, it is possible to reduce or prevent the air above the case 240 from being moved to a to-be-cleaned region C (see FIG. 18A) under the shielding surface 221 through the shielding surface 221.

Therefore, the vacuum cleaner 1' may have improved suction efficiency with the same suction force by sucking dust only in the to-be-cleaned region C substantially sealed from the outside. That is, the cleaner head 200 may improve the suction efficiency of the vacuum cleaner 1' by reducing suction of the outside air other than the air in the to-be-cleaned region C.

In addition, the shielding surface 221 may be made of an elastic material. Accordingly, in case that the shielding surface 221 makes contact with the front wall surface Q2, actual shielding efficiency of the to-be-cleaned region C may be improved.

In addition, the shielding surface 221 itself may not be limited to being made of the elastic material, and a separate elastic member may be coupled to the shielding surface 221.

The above description describes the case where the separate shielding surface 221 is formed on a front end of the bent portion 222. However, as another example, the front end of the bent portion 222 adjacent to the brush 210 may be formed to directly make contact with the front wall surface Q2. In this case, the front end of the bent portion 222 may function to shield the outside air.

The second main case 220-2 may be formed to be perpendicular to a lower surface of the first main case 220-1 to support and fix the side case 230. Accordingly, the first main case 220-1 may form the top surface of the cleaner head 200, and the second main case 220-2 may support the side case 230.

The second main case 220-2 may include a through hole 223*a* through which the rotating shaft 211 of the brush 210 penetrates and a plurality of fixing portions 225 capable of fixing the side case 230. Each of the plurality of fixing portions 225 may have a female screw.

Accordingly, the side case 230 may be fixed to the second main case 220-2.

Meanwhile, the second main case 220-2 may be integrally formed with the first main case 220-1. For example, the first main case 220-1 and the second main case 220-2 may be injection molded together.

Hereinafter, a structure of the side case 230 according to an embodiment of the disclosure is described with reference to FIGS. 14 to 16.

Figure 16:
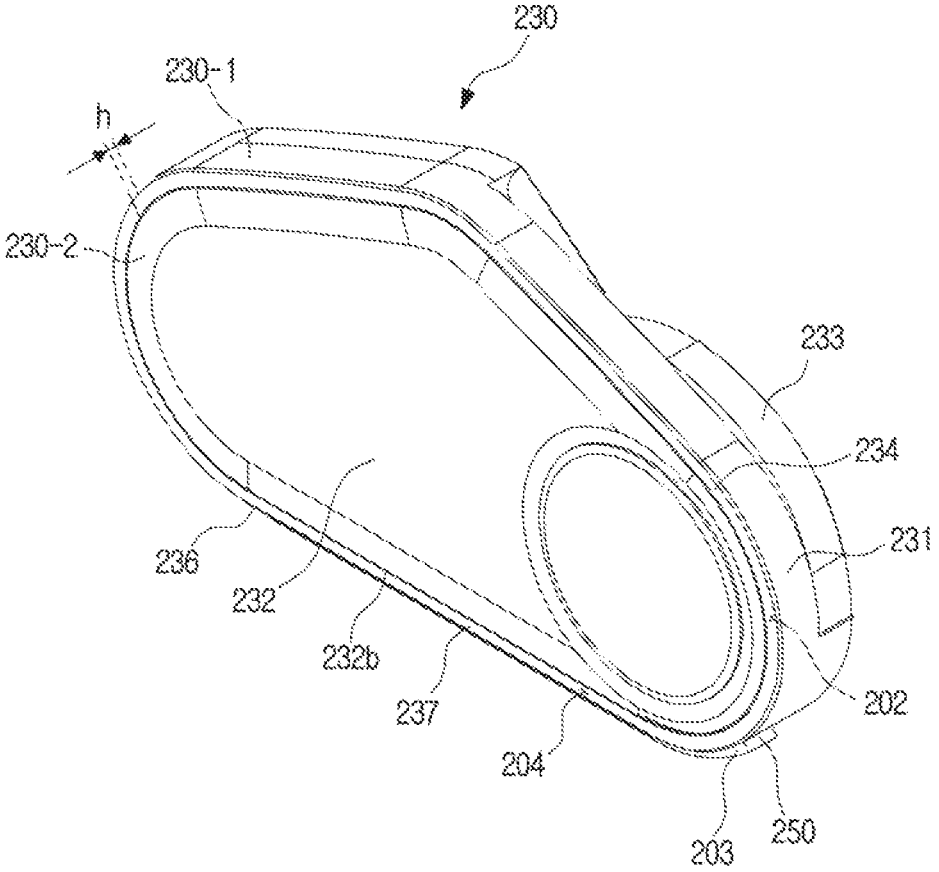
FIG. 16 is a perspective view of a side case according to another embodiment of the disclosure.

FIG. 16 is a perspective view of the side case 230 according to an embodiment of the disclosure.

The side case 230 may be installed at the second main case 220-2. For example, the side case 230 may have a shape corresponding to that of the second main case 220-2.

The side case 230 may include a side case body 230-1 fixed to the second main case 220-2 and a side case cover 230-2 covering an opening of the side case body 230-1.

The side case body 230-1 may have a shape corresponding to that of the second main case 220-2, and may be formed in a shape of a container having a bottom surface. A top surface of the side case body 230-1 may be opposite to the bottom surface and open. The pulleys 214 and 215 and the drive belt 212 may be accommodated in an inner space of the side case body 230-1.

The bottom surface 230*c* of the side case body 230-1 may have thereon, a fixing hole 230*a* to which the through hole 223*a* of the second main case 220-2 corresponds and into which the rotating shaft 211 of the brush 210 is inserted, and a motor shaft hole 230*b* into which the brush motor shaft 213*a* of the brush motor 213 is inserted.

Therefore, the side case 230 may support the rotating shaft 211 of the brush 210 and the brush motor shaft 213*a* of the brush motor 213 to stably rotate the rotating shaft 211 of the rotated brush 210 and the brush motor shaft 213*a* of the brush motor 213.

In addition, the side case body 230-1 may form a space in which the pulleys 214 and 215 and the drive belt 212 are disposed, together with the side case cover 230-2 coupled to the side case body 230-1, thereby protecting the pulleys 214 and 215 and the drive belt 212 from the external impact and preventing the foreign material from being attached to the drive belt 212.

A coupling portion 233 coupled to the bent portion 222 of the main case 220 may be disposed on one side of the top surface of the side case body 230-1.

The side case cover 230-2 may be coupled to the opening of the side case body 230-1 to form the side case 230, and protect the inner space of the side case body 230-1.

A side case 230' may be installed on the opposite side surface of the cleaner head 200. The side case 230' installed on the opposite side surface of the cleaner head 200 may be formed symmetrically with the side case 230 shown in FIG. 16, and any pulley or drive belt is not installed therein.

In case that the side case 230 is installed at the main case 220, the side case 230 may form a step with a front surface of the main case 220. In detail, in case that the side case 230 is fixed to the one side of the main case 220, the bent portion 222 and the shielding surface 221 of the main case 220 may further protrude than an outer circumferential surface of the side case 230. Therefore, the side case 230 may form the step with the front surface of the main case 220, that is, the bent portion 222 and the shielding surface 221.

The air passage 201 through which the air above the main case 220 flows downward may be formed by the step between the side case 230 and the front surface of the main case 220. For example, in case that the cleaner head 200 may be disposed at a corner region between the wall surfaces, and thereby the front surface of the main case 220 is brought into contact with the front wall surface Q2 and the side case 230 is brought into contact with the side wall surface Q1, the side case 230 may be spaced apart from the front wall surface Q2, and one side end 222*a* of the front surface of the main case 220 may be spaced apart from the side wall surface Q1 to form the air passage 201.

The side case 230 may include an air guide surface 231 forming a front surface of the side case 230 and spaced from the front surface of the main case 220 to form the step, and a side surface 232 perpendicular to the surface to-be-cleaned S.

The side surface 232 may be a surface making contact with a side wall surface Q1, and may be formed to be flat. Accordingly, in case that the side surface 132 makes contact with the side wall surface Q1, the air outside the case 240 may be prevented from being moved between the side surface 232 and the side wall surface Q1, and may be moved only through the air guide surface 231 of the side case 230.

The air guide surface 231 may be formed on the front surface of the side case 230, and may form the step with the front surface of the main case 220. That is, the air guide surface 231 may form the air passage 201 through which the air flows, together with the front surface of the main case 220, that is, the one side end 222*a* of the bent portion 222.

Therefore, the step between the front surface 231 of the side case 230 and the front surface of the main case 220 may introduce the air outside the case 240 by the suction force of the vacuum cleaner 1' and blow the introduced air into the to-be-cleaned region C.

Accordingly, it is possible to blow the air at a high velocity into the dust on the to-be-cleaned region C where the suction force of the vacuum cleaner 1' fails to reach because the to-be-cleaned region C is adjacent to a corner between the wall surfaces. Then, the dust in the to-be-cleaned region C may be scattered within the to-be-cleaned region C by the air passed through the air passage 201, and the scattered dust may be sucked into the nozzle 10 through the suction force of the vacuum cleaner 1' and the brush 210.

In addition, the side case 230 may further include a sub air passage 202 formed on one side of the air passage 201.

The sub air passage 202 may be formed as a side step portion 234 formed along a circumference of the side surface 232. That is, in case that the side step portion 234 is formed between the air guide surface 231 and the side surface 232 of the side case 230, the side step portion 234 may form the sub air passage 202 guiding the air above the case 240 toward the bottom of the cleaner head 200.

Figure 18A:
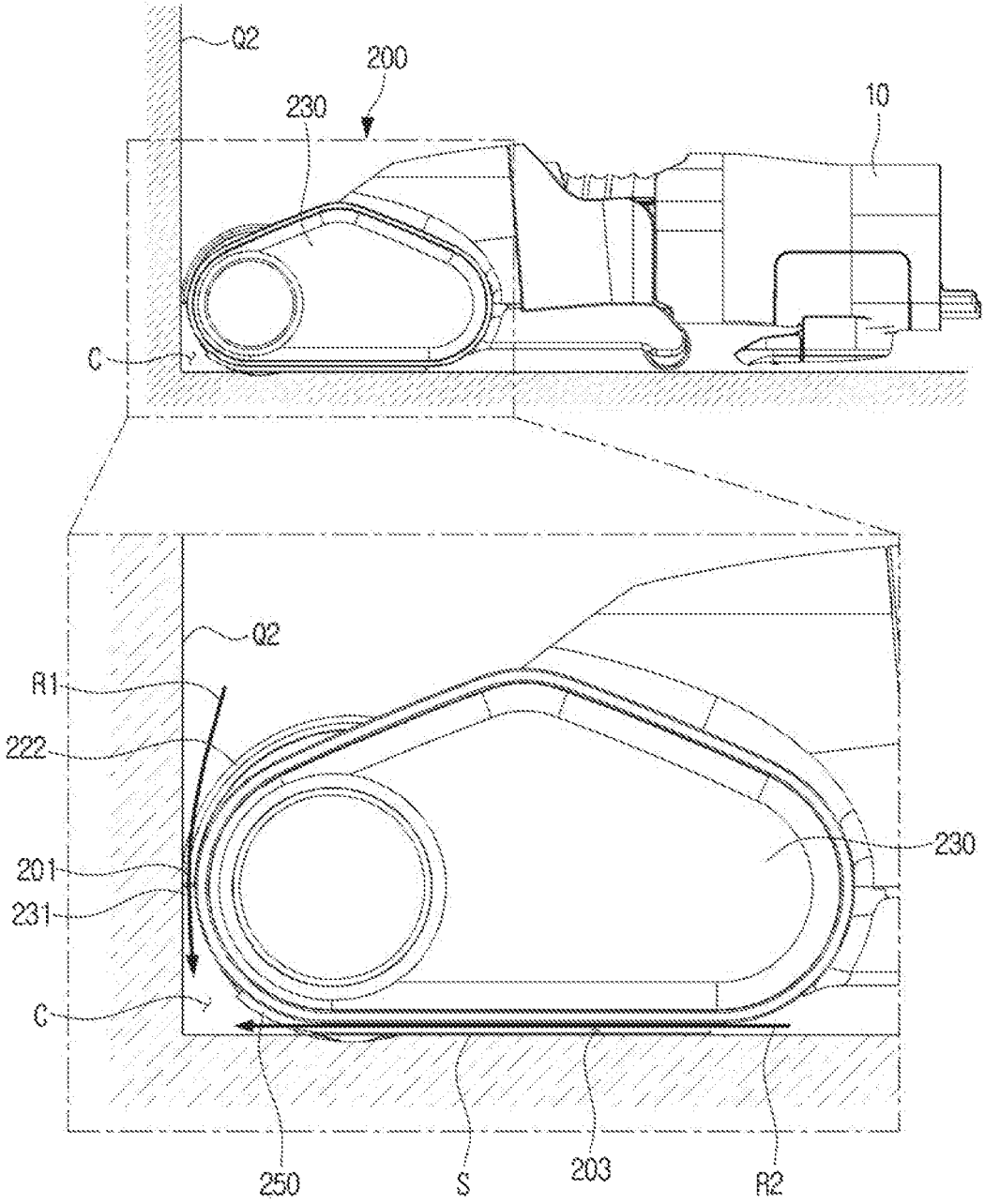
FIG. 18A is a side view of the cleaner head of the vacuum cleaner of FIG. 17.
Figure 18B:
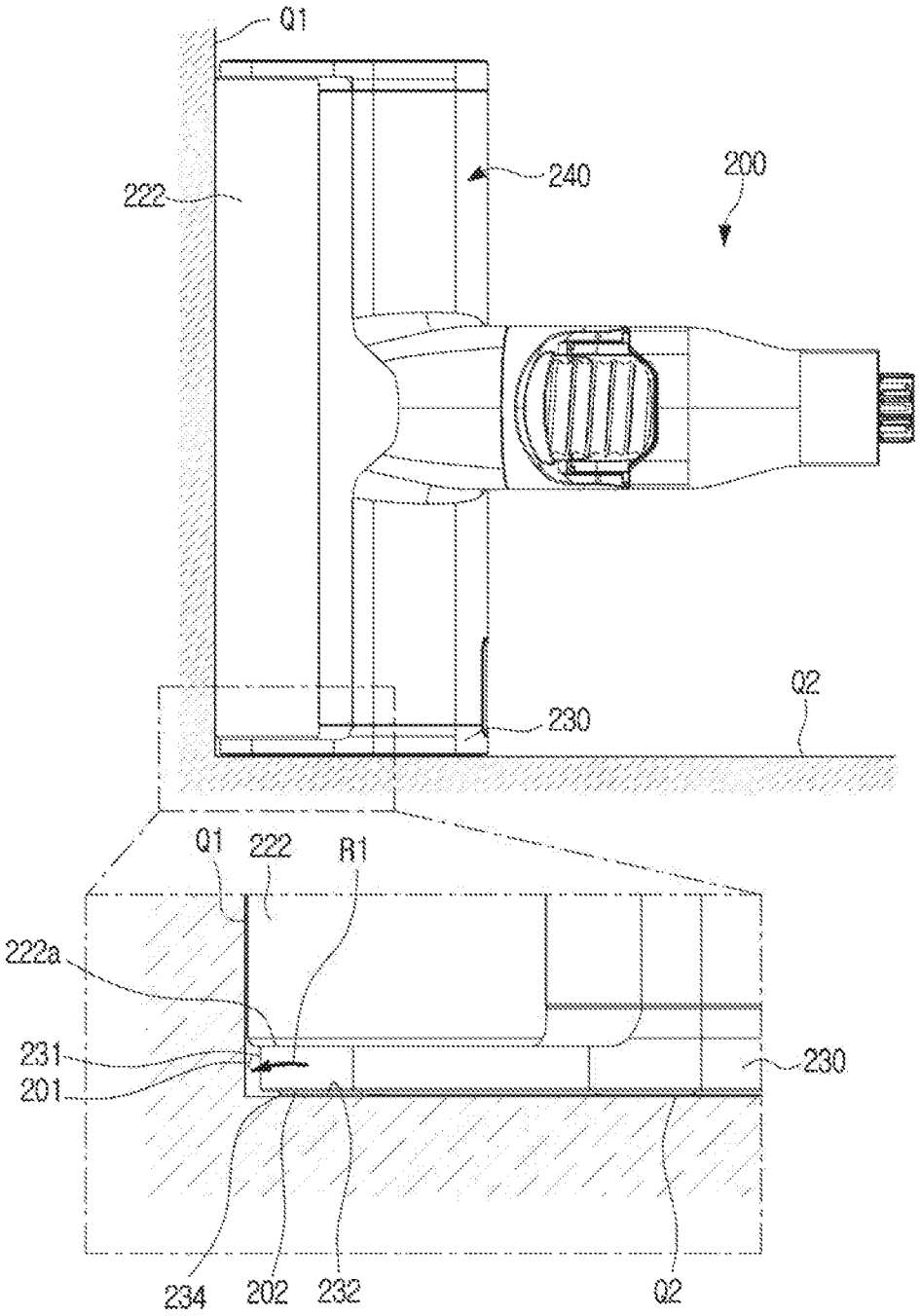
FIG. 18B is a plan view of the cleaner head of the vacuum cleaner of FIG. 17.

For example, in case that the side step portion 234 is formed on the side case 230, when the cleaner head 200 is disposed at the corner region between the wall surfaces, the side step portion 234 may form the sub air passage 202 through which the air passes, together with the side wall surface Q1 (see FIG. 18B).

As described above, the air passage 201 may be operated only in case that the shielding surface 221 of the main case 220 makes contact with the front wall surface Q2 and the side surface 232 of the side case 230 makes contact with the side wall surface Q1.

For example, in case that the shielding surface 221 of the main case 220 and the side surface 232 of the side case 230 are not brought into contact with the front wall surface Q2 and the side wall surface Q1, respectively, there may not be formed the air passage 201 through which the air flows by the air guide surface 231 of the side case 230 and the one side end 222*a* of the front surface of the main case 220.

Accordingly, the air passage 201 may be operated in case that the cleaner head 200 is disposed at the corner region between the wall surfaces, thereby improving the suction efficiency of the vacuum cleaner 1' when generally cleaning the surface to-be-cleaned. In other words, the suction efficiency of the vacuum cleaner 1' may not be reduced by the air passage 201 disposed at each of the opposite ends of the front surface of the case 240.

In addition, referring to FIGS. 13 and 16, the side case 230 may include bristles 250 adjacent to the brush 210 and arranged along a bottom surface 236 of the side case 230.

The bristles 250 may improve cleaning efficiency of the vacuum cleaner 1' by making contact with the surface to-be-cleaned S to sweep the dust accumulated on the surface to-be-cleaned S or allow the dust to be first attached thereto and then the attached dust to be sequentially sucked into the vacuum cleaner 1'.

In addition, as shown in FIG. 13, the bristles 250 may be arranged along a bottom edge of the case 240, adjacent to the surface to-be-cleaned S. The bristles 250 may be arranged in such a manner that a front end portion of the bristles 250 does not interfere with the air flow moved to the to-be-cleaned region C along the air passage 201 on the front surface of the side case 230. Dust attached to the front end portion of the bristles 250 may be removed by the air flow moved through the air passage 201.

Here, the bristles 250 may be arranged to be spaced apart by a predetermined distance from an edge of the bottom surface 236 of the side case 230. Then, a lower step formed by a portion of the bottom surface 236 of the side case 230 and the bristles 250 may form a lower air passage 203. That is, the lower air passage 203 may be formed on the bottom surface 236 of the side case 230 by the bristles 250 arranged along the edge of the bottom surface of the side case 230.

Figure 18C:
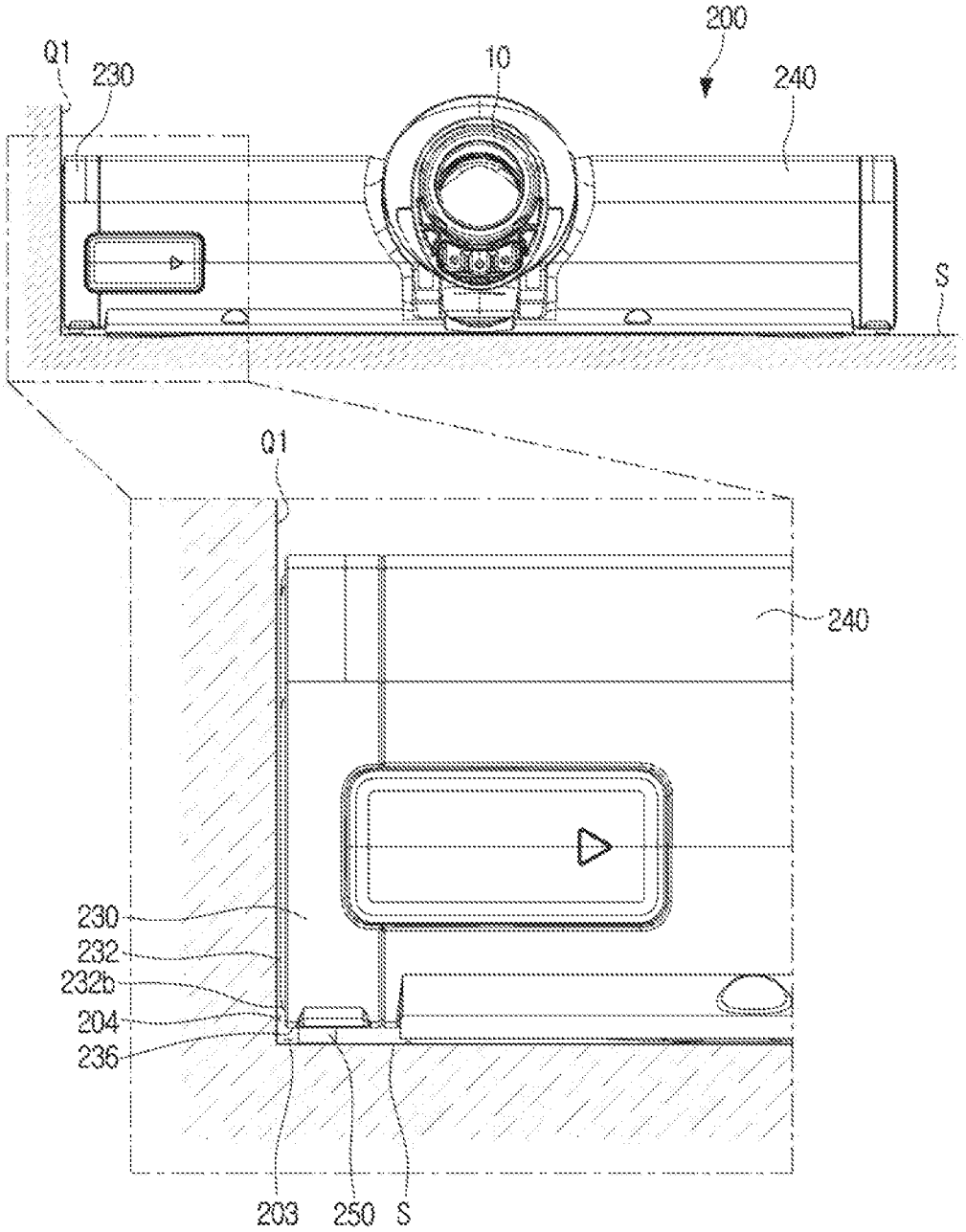
FIG. 18C is a rear view of the cleaner head of the vacuum cleaner of FIG. 17.

In case that the side surface 232 of the side case 230 makes contact with the side wall surface Q1, the lower step between the bristles 250 and the bottom surface 236 of the side case 230 may form the air passage through which the outside air flows, i.e. lower air passage 203, together with the side wall surface Q1 and the surface to-be-cleaned S (see FIG. 18C).

Therefore, in case that the vacuum cleaner 1' is operated to generate the suction force, the outside air may flow to the corner between the wall surfaces through the lower air passage 203. Here, because the lower air passage 203 has a small cross-sectional area, a flow velocity of the air passing through the lower air passage 203 may be increased, such that dust in the corner region between the wall surfaces may be blown away. In addition, the air passing through the lower air passage 203 may remove the dust attached to the bristles 250.

In addition, the side case 230 may further include a sub lower air passage 204 formed on one side of the lower air passage 203.

The sub lower air passage 204 may be formed as a lower side step portion 237 formed along a lower end 232*b* of the side surface 232. That is, in case that the lower side step portion 237 is formed between the bottom surface 236 of the side case 230 and the lower end 232*b* of the side surface 232, the lower side step portion 237 may form the sub lower air passage 204 guiding the air behind the cleaner head 200 toward the front of the cleaner head 200.

For example, in case that the lower side step portion 237 is formed on the side case 230, when the cleaner head 200 is disposed at the corner region between the wall surfaces, the lower side step portion 237 may form the sub lower air passage 204 through which the air passes, together with the side wall surface Q1 and the surface to-be-cleaned S.

As described above, in case that the sub lower air passage 204 is formed on the one side of the lower air passage 203 of the side case 230, an amount of the air moved from behind the cleaner head 200 to the to-be-cleaned region C in front of the cleaner head 200 may be increased. Therefore, the vacuum cleaner 1' may improve cleaning efficiency of removing the dust from the to-be-cleaned region C of the corner between the wall surfaces.

The above-described sub air passage 202 and sub lower air passage 204 may be formed by forming the step portion along the circumference of the side surface 232 of the side case 230. In this case, the lower side step portion 237 formed on the lower end 232*b* of the side surface 232 and the side step portion 234 formed on the front surface of the side surface 232 may be connected to each other. Accordingly, the side surface 232 may further protrude to a predetermined height (h) than the one side end of the outer circumferential surface of the side case 230.

The embodiment shown in FIG. 13 describes the case where the bristles 250 are arranged to be spaced apart by the predetermined distance from the edge of the bottom surface 236 of the side case 230. In this case, the portion of the bottom surface 236 of the side case 230 and the bristles 250 may form the lower air passage 203, and the sub lower air passage 204 may be formed by forming the lower side step portion 237 between the lower end 232*b* of the side surface 232 and the bottom surface 236 of the side case 230.

However, as another example, the bristles 250 may be arranged to coincide with the edge of the bottom surface 236 of the side case 230. In this case, no step portion may be formed between the bottom surface 236 of the side case 230 and the bristles 250, and only the lower side step portion 237 may be formed between the bottom surface 236 of the side case 230 and the lower end 232*b* of the side surface 232. Then, the lower side step portion 237 may function as the lower air passage 203 guiding the air behind the cleaner head 200 to the front of the cleaner head 200.

The bristles 250 may be made of a material capable of improving the cleaning efficiency of the vacuum cleaner 1'. As another example, the bristles 250 may be made of various materials such as the elastic material, a plastic injection material, and a sealing member to implement shielding effect of the cleaner head 200.

Hereinafter, operations of the cleaner head 200 and the vacuum cleaner 1' according to another embodiment of the disclosure are described with reference to FIGS. 17 to 19.

Figure 17:
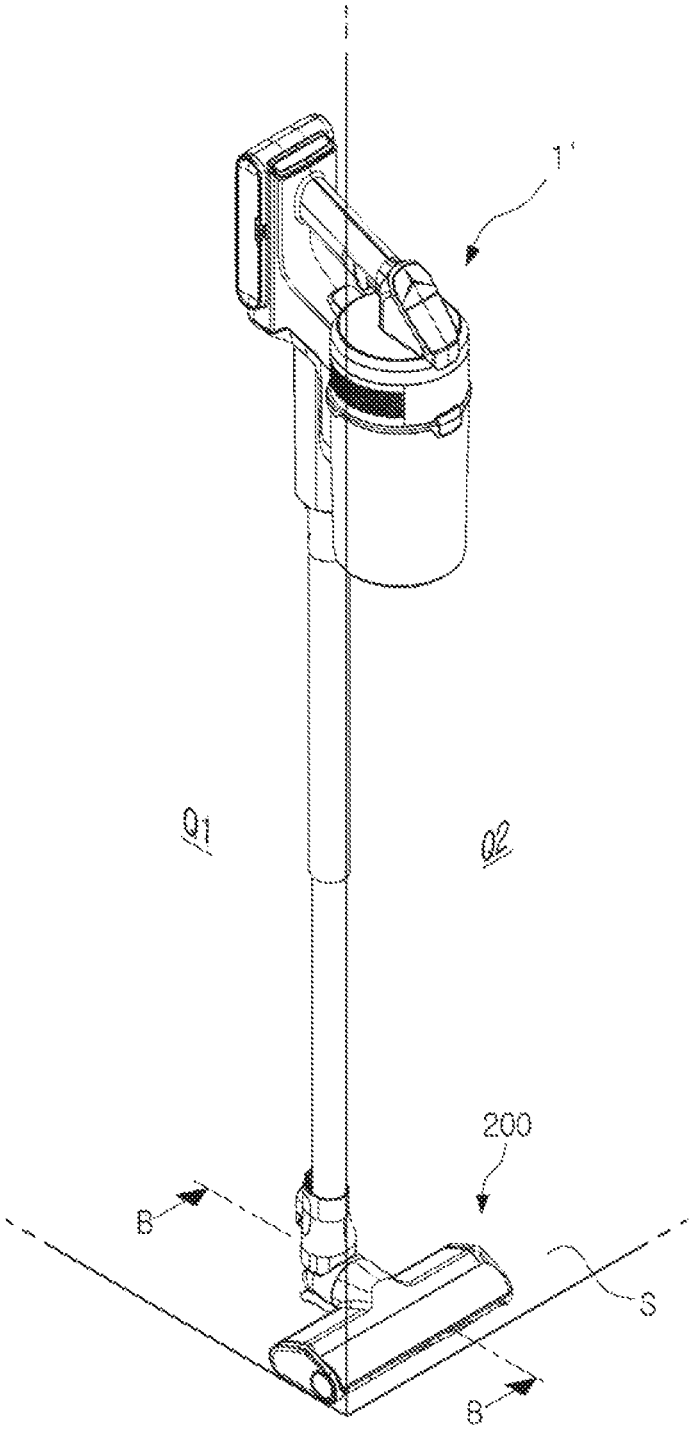
FIG. 17 is a view showing a state in which a vacuum cleaner according to another embodiment of the disclosure is disposed at a corner between wall surfaces.
Figure 18D:
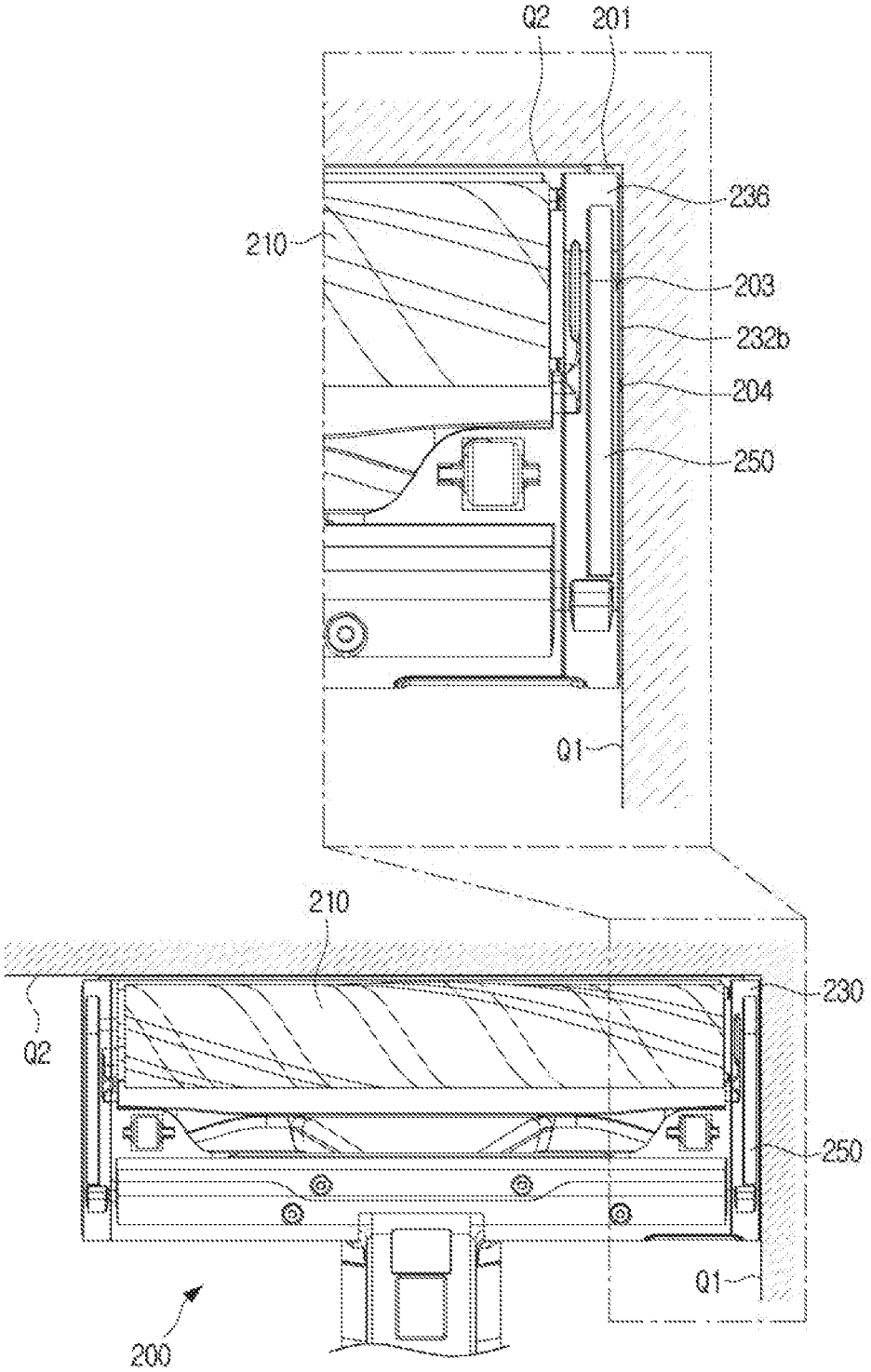
FIG. 18D is a bottom view of the cleaner head of the vacuum cleaner of FIG. 17.

FIG. 17 is a perspective view showing a state in which the vacuum cleaner 1' according to another embodiment of the disclosure is disposed at the corner between wall surfaces; FIG. 18A is a side view of the cleaner head of the vacuum cleaner of FIG. 17; and FIG. 18B is a plan view of the cleaner head of the vacuum cleaner of FIG. 17. FIG. 18C is a rear view of the cleaner head of the vacuum cleaner of FIG. 17; and FIG. 18D is a bottom view of the cleaner head of the vacuum cleaner of FIG. 17. FIG. 19 is a cross-sectional view taken along line B-B of FIG. 17.

As shown in FIG. 17, the cleaner head 200 of the vacuum cleaner 1' may be disposed at the corner region between the wall surfaces to clean the corner portion between the wall surfaces.

Here, the corner region between the wall surfaces may be formed of the surface to-be-cleaned S which is a floor, the side wall surface Q1 and the front wall surface Q2. In addition, the side wall surface Q1 may refer to a wall surface facing the side case 230 of the cleaner head 200, and the front wall surface Q2 may refer to a wall surface facing the shielding surface 221.

In addition, as shown in FIG. 18A, the case 240 may contact the front wall surface Q2, and thereby the cleaner head 200 may form the to-be-cleaned region C which is a space between the surface to-be-cleaned S and the front wall surface Q2.

In detail, the shielding surface 221 of the cleaner head 200 may make contact with the front wall surface Q2, and therefore the air outside the case 240 may not be introduced into the to-be-cleaned region C by the shielding surface 221.

Accordingly, the suction force of the vacuum cleaner 1' may not be used to introduce the air outside the case 240 and may be used to suck the dust in the to-be-cleaned region C. Therefore, the suction force may not be wasted, thereby improving the suction efficiency of the vacuum cleaner 1'.

In addition, as shown in FIG. 18B, the side case 230 may make contact with the side wall surface Q1. In detail, the side surface 232 of the side case 230 may make contact with the side wall surface Q1.

Accordingly, the air outside the case 240 may be prevented from being introduced through the side surface 232 of the side case 230, and may be introduced into the to-be-cleaned region C only through the air passage 201 formed on the side case 230.

In detail, the air above the case 240 may be introduced into the air passage 231 by the suction force of the vacuum cleaner 1', which is generated in case that the vacuum cleaner 1' disposed in the corner region between the wall surfaces is operated as shown in FIG. 17.

For example, the air above the case 240 may form a first air flow R1 moved from above the case 240 toward the surface to-be-cleaned S through the air passage 201 formed by the air guide surface 231 of the side case 230, the one side end 222*a* of the front surface of the main case 220, the front wall surface Q2 and the side wall surface Q1.

In addition, in case that the sub air passage 202 is formed on the side case 230, the air above the case 240 may be moved toward the surface to-be-cleaned S also through the sub air passage 202.

Here, the air passage 201 has a very small cross-sectional area and the air flow passing through the air passage 201 may thus have a fast flow velocity.

Subsequently, the air flow R1 passed through the air passage 201 may scatter the dust in the corner region between the wall surfaces.

In addition, in case that the vacuum cleaner 1' is operated, the air behind the cleaner head 200 may be introduced into the lower air passage 203 by the suction force of the vacuum cleaner 1'.

For example, the air behind the cleaner head 200 may form a second air flow R2 moved from behind the cleaner head 200 toward the front wall surface Q2 through the lower air passage 203 formed by the bottom surface 236 of the side case 230, the side surface of the bristles 250, the side wall surface Q1 and the surface to-be-cleaned S.

In addition, in case that the sub lower air passage 204 is formed on the side case 230, the air behind the cleaner head 200 may be moved toward the front wall surface Q2 also through the sub lower air passage 204.

Here, the lower air passage 203 has a small cross-sectional area and the air flow passing through the lower air passage 203 may thus have a fast flow velocity.

Therefore, the dust in the corner region between the wall surfaces may be scattered also by the air flow R2 passed through the lower air passage 203. In addition, the air flow R2 passing through the lower air passage 203 may remove the dust attached to the bristles 250 and scatter the dust within the to-be-cleaned region C.

Figure 19:
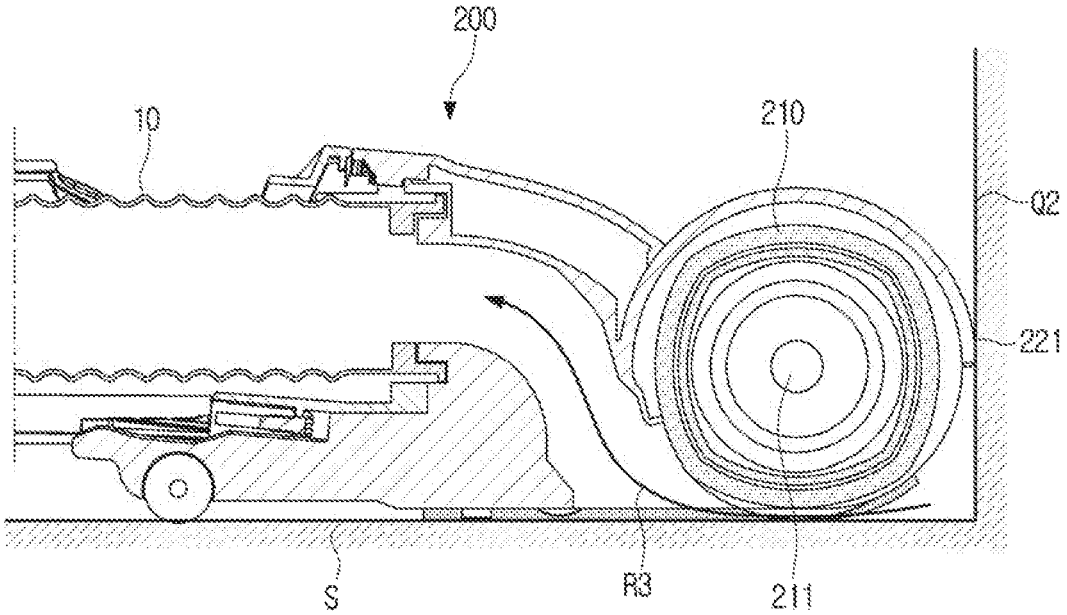
FIG. 19 is a cross-sectional view taken along line B-B of FIG. 17.

Next, as shown in FIG. 19, the dust scattered by the air flows R1 and R2 passed through the air passage 201 and the lower air passage 203, respectively, may be moved along the air flow R3 sucked into the nozzle 10. Therefore, the air passage 201 and the lower air passage 203 of the cleaner head 200 may efficiently remove the dust from the corner region between the wall surfaces. That is, the air moved through the air passage 201 and the lower air passage 203 may remove the dust from the region where the brush 210 and the bristles 250 fail to sweep.

Accordingly, the cleaner head 200 according to an embodiment of the disclosure may improve dust removal efficiency of removing the dust from the corner region between the wall surfaces.

Although the diverse embodiments of the disclosure are individually described hereinabove, the respective embodiments are not necessarily implemented singly, and may also be implemented so that configurations and operations thereof are combined with those of one or more other embodiments.

In addition, although the embodiments of the disclosure are illustrated and described hereinabove, the disclosure is not limited to the above-mentioned specific embodiments, but may be variously modified by those skilled in the art to which the disclosure pertains without departing from the scope and spirit of the disclosure as disclosed in the accompanying claims. These modifications also need to be understood to fall within the scope of the disclosure.

What is claimed is:

1. A cleaner head comprising:

a case configured so that, when the cleaner head is positioned on a surface to-be-cleaned, a first edge region of a planar exterior side surface of the case is in contact with an upper surface of the case and a second edge region of the exterior side surface is adjacent to the surface to-be-cleaned, the case including a nozzle connection portion, and an air passage groove within the exterior side surface, recessed from a plane defined by the exterior side surface, extending from the first edge region to the second edge region, and having a width that is smaller at the second edge region than at the first edge region, so that, when a suction force through the cleaner head is generated with the cleaner head positioned on the surface to-be-cleaned, air flow along the air passage groove from the first edge region and then to the second edge region and then to the surface to-be-cleaned is generated so that foreign materials on the surface to-be-cleaned are drawn by the air flow; and a brush rotatably disposed in an interior of the case and configured to rotate to move the drawn foreign materials from the surface to-be-cleaned into the case, to thereafter be provided to the nozzle connection portion, wherein the case is configured so that, while the cleaner head is positioned on the surface to-be-cleaned and the exterior side surface makes contact with a wall surface, a passage enclosed by the air passage groove and the wall surface is formed.

2. The cleaner head as claimed in claim 1, wherein the air passage groove includes at least a portion that continuously decreases in width toward the second edge region.

3. The cleaner head as claimed in claim 1, wherein the air passage groove includes:

a first air passage groove portion having a first cross-sectional area and extending toward the second edge region; and a second air passage groove portion connected to the first air passage groove portion and having a second cross-sectional area greater than the first cross-sectional area and extending toward the first edge region.

4. The cleaner head as claimed in claim 3, wherein a width of the second air passage groove portion becomes smaller as the second air passage groove portion extends toward the first air passage groove portion from the first edge region.

5. The cleaner head as claimed in claim 1, wherein a portion of the air passage groove has a constant width between the first edge region and the second edge region.

6. The cleaner head as claimed in claim 1, further comprising:

a rotation shaft about which the brush rotates, wherein the exterior side surface is perpendicular to a rotation axis of the rotation shaft, and an end of the rotation shaft is adjacent to the exterior side surface.

7. The cleaner head as claimed in claim 1, wherein the case further includes:

a main case portion including a shielding surface connected to the brush and disposed to extend forward past an outer region of the brush; and a side case portion connected to the main case portion, wherein the exterior side surface is an exterior side surface of the side case portion.

8. The cleaner head as claimed in claim 7, further comprising:

a rotation shaft about which the brush rotates, wherein the shielding surface is disposed in a direction parallel to a rotation axis of the rotation shaft and protrudes toward a front of the cleaner head.

9. The cleaner head as claimed in claim 7, further comprising:

a rotation shaft about which the brush rotates, wherein the main case portion further includes:

a first main case portion exposing a portion of the brush; and a second main case portion having a fixing hole into which the rotation shaft is inserted.

10. The cleaner head as claimed in claim 9, wherein the air passage groove is configured so that the generated air flow flows from the second edge region toward the surface to-be-cleaned adjacent to the exposed portion of the brush.

11. The cleaner head as claimed in claim 1, wherein, when the cleaner head is positioned on the surface to-be-cleaned, the exterior side surface is perpendicular to the surface to-be-cleaned.

12. The cleaner head as claimed in claim 7, wherein the side case portion includes bristles adjacent to the brush and arranged along a bottom edge of the side case portion.

* * * * *